US007956540B2

(12) United States Patent
Yamakita et al.

(10) Patent No.: US 7,956,540 B2
(45) Date of Patent: Jun. 7, 2011

(54) PLASMA DISPLAY PANEL

(75) Inventors: Hiroyuki Yamakita, Osaka (JP); Masatoshi Kitagawa, Osaka (JP); Mikihiko Nishitani, Nara (JP)

(73) Assignee: Panasonic Corporation, Osaka (JP)

( * ) Notice: Subject to any disclaimer, the term of this patent is extended or adjusted under 35 U.S.C. 154(b) by 595 days.

(21) Appl. No.: 11/572,900

(22) PCT Filed: Aug. 11, 2005

(86) PCT No.: PCT/JP2005/014733

§ 371 (c)(1),
(2), (4) Date: Aug. 18, 2008

(87) PCT Pub. No.: WO2006/019031

PCT Pub. Date: Feb. 23, 2006

(65) Prior Publication Data

US 2008/0315768 A1 Dec. 25, 2008

(30) Foreign Application Priority Data

Aug. 17, 2004 (JP) ..... 2004-237716
Mar. 29, 2005 (JP) ..... 2005-095737

(51) Int. Cl.
*H01J 17/49* (2006.01)

(52) U.S. Cl. ..... 313/586; 313/583; 313/587

(58) Field of Classification Search ..... 313/582–587; 315/169.4; 345/60, 30, 37, 41, 71
See application file for complete search history.

(56) References Cited

U.S. PATENT DOCUMENTS

| | | | | |
|---|---|---|---|---|
| 6,160,345 | A | 12/2000 | Tanaka et al. | |
| 6,439,943 | B1 | 8/2002 | Aoki et al. | |
| 6,450,849 | B1 | 9/2002 | Harada | |
| 7,045,962 | B1 | 5/2006 | Murai et al. | |
| 7,071,621 | B1 | 7/2006 | Namiki et al. | |
| 2001/0011974 | A1 | 8/2001 | Kang et al. | |
| 2002/0034917 | A1 | 3/2002 | Tanaka et al. | |
| 2002/0036466 | A1 | 3/2002 | Tanaka et al. | |
| 2002/0137424 | A1 | 9/2002 | Harada | |
| 2002/0190651 | A1* | 12/2002 | Law et al. | 313/587 |
| 2003/0197468 | A1* | 10/2003 | Shibata et al. | 313/586 |
| 2003/0218424 | A1* | 11/2003 | Law et al. | 313/587 |
| 2005/0174057 | A1 | 8/2005 | Su | |
| 2006/0113909 | A1 | 6/2006 | Su | |

(Continued)

FOREIGN PATENT DOCUMENTS

JP 55-143754 11/1980

(Continued)

OTHER PUBLICATIONS

Japanese Application No. 2006-531723 Office Action dated Mar. 1, 2011, 2 pages.

*Primary Examiner* — Peter Macchiarolo

(57) ABSTRACT

A PDP (101) with a reduced discharge inception voltage and discharge sustaining voltage for improving luminous efficiency has at least a pair of substrates (110 and 111) that are disposed in opposition to sandwich a discharge space therebetween. At least a portion of at least one of the substrates has two or more display electrode pairs (104) that include narrow bus electrodes (159 and 169), a dielectric layer (107) formed so as to cover the display electrode pairs (104), and a protective layer (108) formed so as to cover the dielectric layer (107). The dielectric layer (107) has a dense film structure with a dielectric breakdown voltage of $1.0\times10^6$ [V/cm] to $1.0\times10^7$ [V/cm].

7 Claims, 12 Drawing Sheets

U.S. PATENT DOCUMENTS

| | | | | |
|---|---|---|---|---|
| 2006/0132039 | A1 | 6/2006 | Murai et al. | |
| 2008/0211408 | A1* | 9/2008 | Yamakita et al. | 313/586 |
| 2008/0252214 | A1* | 10/2008 | Yamakita | 313/584 |
| 2009/0219228 | A1* | 9/2009 | Kim et al. | 345/60 |

FOREIGN PATENT DOCUMENTS

| | | |
|---|---|---|
| JP | 3-233829 | 10/1991 |
| JP | 4-4542 | 1/1992 |
| JP | 4-218238 | 8/1992 |
| JP | 9-223465 | 8/1997 |
| JP | 10-188818 | 7/1998 |
| JP | 2000-021304 | 1/2000 |
| JP | 2000-156165 | 6/2000 |
| JP | 2000-156168 | 6/2000 |
| JP | 2000-306515 | 11/2000 |
| JP | 2001-235895 | 8/2001 |
| JP | 2001-243883 | 9/2001 |
| JP | 2003-007217 | 1/2003 |
| JP | 2004-039601 | 2/2004 |
| JP | 2004-178880 | 6/2004 |
| JP | 2004-200057 | 7/2004 |
| JP | 2005-222934 | 8/2005 |

* cited by examiner

PLASMA DISPLAY PANEL

TECHNICAL FIELD

The present invention relates to a plasma display panel and a method for manufacturing the same, and to a reduction in the discharge sustaining voltage etc. during driving of the PDP, as well as an increase in the lifetime of the PDP.

BACKGROUND ART

Plasma display panels (hereinafter, referred to as "PDPs") are one type of thin display device, and include direct current (DC) and alternating current (AC) types. AC PDPs have a high technological potential in view of large screen sizes, and among AC PDPs, surface discharge PDPs have attracted attention in particular due to their lifetime properties.

1. PDP Structure

FIGS. 11A and 11B show a structure of a surface discharge AC PDP that is constituted from a front plate 702 and a back plate 703 disposed in opposition to sandwich a discharge space therebetween.

As shown in FIGS. 11A and 11B, the front plate 702 is constituted from a glass substrate 710 whose main surface on the discharge space side has a display electrode pair 704 constituted from a scan electrode 705 and a sustain electrode 706, a dielectric layer 707, and a protective layer 708 laminated successively thereon. The scan electrode 705 and the sustain electrode 706 are disposed in opposition to sandwich a gap D therebetween of 50 [μm] and 100 [μm], and are each constituted from a bus electrode 709 and transparent electrodes 755 and 756 respectively.

The bus electrodes 709 are metallic and narrow with a film thickness of 5 [μm] to 6 [μm], and are disposed on main surfaces of the transparent electrodes 755 and 756. The bus electrodes 709 are provided by, for example, a thick film process of printing a layer of Ag paste, and baking the printed layer.

The dielectric layer 707 is formed by a thick film process of baking a low melting glass paste that includes a lead glass material as a main component and has been applied by a printing method, and the film thickness of the dielectric layer 707 is set to approximately 40 [μm].

The lead glass material used in the dielectric layer 707 has, for example, a relative dielectric constant $\in$ of approximately 13.

The protective layer 708 has a film thickness set to several hundred [nm], and a main component thereof is MgO having good electrical insulating properties.

An area where one display electrode pair 704 and a data electrode 712 included in the back plate 703 three-dimensionally intersect is called a discharge cell, and the areas shown in FIGS. 11A and 11B correspond to discharge cells.

It is the display electrode pair 704 that directly contributes to PDP image display, whereas the data electrode 712 is for selecting a discharge cell, which is a unit of image display, and does not directly contribute to emission in image display.

The PDP is made up of discharge cells, which are units of image display, arranged in a matrix configuration. The PDP is assumed to be a PDP apparatus that includes a known drive circuit, control circuit, and the like.

2. PDP Drive Method

Display of the PDP is driven by an address-display separation drive scheme that includes three operation periods, which are specifically (1) an initialization period in which all display cells are put into an initialized state, (2) a data writing period in which the discharge cells are addressed, and display states corresponding to input data are selected and input to the addressed discharge cells, and (3) a sustained discharge period in which the discharge cells in the display states are caused to perform display emission.

In (3) the sustained discharge period, rectangular voltage pulses of approximately 200 [V] and having mutually different phases are applied to the scan electrode 705 and the sustain electrode 706 in discharge cells in which wall charges corresponding to input data have been formed during (2) the writing period. In other words, applying alternating voltages between display electrode pairs causes the generation of pulse discharges in discharge cells to which display states have been written, each time there is a change in voltage polarity.

Xenon is excited by the sustain discharge, ultraviolet radiation is emitted from the excited xenon, and the ultraviolet radiation is converted to visible light by a phosphor layer 715, thereby causing image display.

However, as previously mentioned, in a conventional PDP the bus electrodes 709 and the dielectric layer 707 are formed by thick film processes that include a baking step. The baking step involves high temperatures between 500 [° C.] and 600 [° C.], and there are cases in which the binder baking material included in the paste remains in the bus electrodes 709 after baking.

Therefore, during baking of the dielectric layer 707, gas bubbles readily form in portions where the bus electrodes 709 and the dielectric layer 707 are in contact, and areas of the dielectric layer 707 corresponding to such bubble formation areas are thinner than other areas of the dielectric layer 707. Also, given that the dielectric layer 707 has a low dielectric breakdown voltage of approximately $2.5\times10^5$ [V/cm] since the density of the baking material is low, thin areas are formed in the dielectric layer 707, resulting in a low withstand voltage in the PDP. As such, dielectric breakdown readily occurs in the dielectric layer 707 during high voltage application etc. in the initialization period.

It is therefore necessary to set the film thickness of the dielectric layer 707 to a high 40 [μm] in a conventional PDP in order to improve the withstand voltage of the dielectric layer 707, and as a result, it is necessary to set the discharge inception voltage and discharge sustaining voltage high, which makes it difficult to improve the luminous efficiency.

One technique that has been disclosed in response to this problem (e.g., see patent document 1) is a dielectric layer that has a multilayer film structure formed by using a vacuum deposition method or sputtering method to laminate, in the stated order, a first layer composed of $Al_2O_3$, a second layer composed of glass including 80% $SiO_2$, and a third layer composed of $Al_2O_3$, where the first layer directly covers electrodes including double layers of Cr and Cu formed by vacuum deposition.

According to the invention recited in patent document 1, cracks do not occur since an $Al_2O_3$ film formed by a thin film process using a vapor deposition method or sputtering method is used as the first and third layers, and using glass including 80% $SiO_2$ as the second layer enables the formation of a thin dielectric layer in which cracks do not occur.

Further disclosed (e.g., see patent document 2) is a dielectric layer composed of a bottom layer and a top layer, the bottom layer being composed of a metal oxide formed on an electrode by a vacuum process such as a CVD method, sputtering, or deposition, and the top layer being composed of dielectric glass formed on the bottom layer.

According to the invention recited in patent document 2, a thin dielectric layer in which dielectric breakdown does not readily occur during PDP driving can be formed by, when coating the dielectric layer on an Ag electrode formed by printing an Ag paste and baking the paste, first using a CVD method to form a layer of a metal oxide that generates a hydroxyl group on the surface such as ZnO, $ZrO_2$, MgO, $TiO_2$, $SiO_2$, $Al_2O_3$, $Cr_2O_3$, etc. with a thickness of 0.1 [μm] to 10 [μm] on a surface of the Ag electrode, and then coating a dielectric layer composed of dielectric glass thereupon.

Also, it is known in such a PDP that a microscopic electrode pair may be disposed in the gap D as a means for reducing the discharge inception voltage and discharge sustaining voltage to lower energy consumption.

For example, patent document 3 discloses a pair of auxiliary electrodes (trigger electrodes) that are disposed in a gap between a scan electrode and a sustain electrode, where each of the auxiliary electrodes is provided with wings at a center of a discharge cell, so as to have a wider area at the center portion of the discharge cell than at the edges thereof. Since discharges occur in gaps between the provided wings, sustain discharges occur reliably even with a low discharge sustaining voltage and discharge inception voltage, thereby enabling an improvement in discharge efficiency during sustain discharges.

Also, patent document 4 discloses, as shown in a discharge cell 800 of FIG. 12, a scan electrode 805 and a sustain electrode 806 constituting a main display electrode pair 802, and an auxiliary discharge electrode pair 801 that is formed on opposing faces of the scan electrode 805 and the sustain electrode 806 to sandwich a gap g therebetween that is narrower than a gap G sandwiched by the electrodes 805 and 806, and has a higher sheet resistivity than the main display electrode pair 802. Furthermore, the applied voltage pulse is a rectangular pulse that has a high luminous efficiency, and the voltage value thereof is set such that a discharge does not occur between the scan electrode 805 and the sustain electrode 806 when there is not discharge between the auxiliary display electrodes constituting the auxiliary display electrode pair 801, but does occur between the scan electrode 805 and the sustain electrode 806 when there is a discharge between the auxiliary display electrodes. Note that FIG. 12 is a relevant planar diagram indicating part of a display electrode pair of a PDP, where the view is from a back plate not depicted, and the area enclosed in a dashed double-dotted line corresponds to the discharge cell.

Employing this structure and setting the voltage value as mentioned above enables control of the discharge delay time and shorter discharge delays, and can be expected to reliably initiate sustain discharges even if the discharge inception voltage is lowered.

Patent document 1: Japanese Patent Application Publication No. S55-143754

Patent document 2: Japanese Patent Application Publication No. 2003-7217

Patent document 3: Japanese Patent Application Publication No. 2001-236895

Patent document 4: Japanese Patent Application Publication No. H04-4542

DISCLOSURE OF THE INVENTION

Problems Solved by the Invention

However, patent document 1 does not indicate any contributions by the invention disclosed therein regarding withstand voltage, discharge inception voltage, or luminous efficiency, and given that the dielectric layer includes three layers with mutually different materials formed by a vacuum deposition method or sputtering method, there are different film formation conditions for each of the different target materials when forming the layers. This is a complicated thin film process, which makes it difficult to reliably and stably manufacture the PDP. Furthermore, the dielectric layer, which is formed by a vacuum deposition method or sputtering method using glass including 80% $SiO_2$ and $Al_2O_3$ still has a low density and small dielectric breakdown voltage, thereby making it necessary to make the dielectric layer thicker to improve the withstand voltage, and requiring a high discharge inception voltage and discharge sustain voltage for the discharge cell. In this case, it is difficult to improve luminous efficiency.

Also, in the invention of patent document 2, a metal oxide is formed by a CVD method etc. on an electrode formed by applying and baking an Ag paste, and a dielectric layer composed of dielectric glass is formed further thereon. Therefore, the metal oxide is formed by a CVD method so as to cover the thick Ag electrode, making it difficult to prevent gas bubbles etc. since the dielectric layer is further coated thereon and baked. Moreover, a thin film process and printing process are employed as processes for forming the dielectric layer, and the dielectric layer absorbs impure gases since such steps involve exposure to air, thereby making it difficult to reliably and stably manufacture the PDP.

Also, protective layers in both of the inventions of patent documents 1 and 2 are exposed to the air after having been formed by thin film processes, and therefore absorb impurities in the air.

Specifically, the metal oxide such as MgO constituting the protective layers absorbs water ($H_2O$) and gas impurities such as carbon dioxide ($CO_2$), and easily changes in nature due to the hydroxylate compound and carbonic compound, and therefore a PDP including a protective layer whose main component is MgO that has changed in nature due to a hydroxylate compound and carbonic compound will have a lower secondary electron emission coefficient than a PDP including a protective layer whose main component is proper MgO. The discharge inception voltage therefore increases and the sputter resistance property is reduced.

Also, in the invention recited in patent document 3, the discharge inception voltage required to reliably initiate a sustain discharge remains high at approximately 180 [V], which is too high in light of demand to reduce the energy consumption of PDPs.

Also, if the discharge delay is reduced, it should be possible to reliably initiate a sustain discharge even if the discharge inception voltage is reduced. However, even though the discharge delay is lowered in the invention recited in patent document 4, the voltage value is set such that discharges occur at the same time between the auxiliary display electrode pair 801 and between the main display electrode pair 802, as a result of which, the voltage value must be set high so as to generate the sustain discharges, and the discharge inception voltage is high at approximately 180 [V], which is too high in light of demand to reduce the energy consumption of PDPs.

The present invention has been achieved in view of such problems, and aims to provide a PDP able to lower the discharge inception voltage and discharge sustain voltage and improve luminous efficiency, and a manufacturing method for the PDP, which is able to improve the lifetime of the PDP and manufacture the PDP with stable quality.

Means to Solve the Problems

The present invention employs the following means in order to solve the aforementioned problems.

Specifically, in a plasma display panel of the present invention, a pair of substrates have been disposed in opposition to sandwich therebetween a discharge space, a plurality of display electrode pairs have been disposed extending on one of the substrates on a main surface facing the discharge space, the display electrode pairs are each composed of a first and a second electrode, each of the first and second electrodes is composed of a band-shaped transparent electrode and a bus electrode that is provided on the transparent electrode on a surface thereof facing the discharge space and that is narrower than the width of the transparent electrode in the width direction, a dielectric layer has been laminated on one of the substrates on a surface thereof facing the discharge space so as to cover the display electrode pairs, and a protective layer has been laminated on the dielectric layer on the main surface thereof facing the discharge space, wherein the dielectric layer has a dielectric breakdown voltage of $1.0\times10^6$ [V/cm] to $1.0\times10^7$ [V/cm] inclusive.

In the present invention, a manufacturing method for the plasma display panel includes the steps of: laminating a dielectric layer on a main surface of a substrate; and transporting or storing the substrate on which the dielectric layer has been laminated, wherein a reduced pressure state is maintained from the dielectric layer lamination step until the dielectric layer-laminated substrate transportation/storage step.

Also, in the present invention, a manufacturing method for a plasma display panel includes the steps of: laminating a dielectric layer on a substrate main surface; laminating a protective film on a main surface of the dielectric layer; and transporting or storing the substrate on which the protective film has been laminated, wherein a reduced pressure state is maintained from the protective film lamination step until the protective film-laminated substrate transportation/storage step.

Also, in order to achieve the above aim, in the PDP of the present invention, the PDP may be provided with a substrate having disposed extending on a main surface thereof a display electrode pair composed of a first and second electrode, and a plurality of discharge cells may be arranged in a direction in which the display electrode pair extends, wherein each of the first and second electrodes includes a band-shaped base and a plurality of protrusions protruding from the base toward the base of the other one of the electrodes in the pair, at least two of the protrusions of the first electrode and of the second electrode existing in each cell.

Also, in the PDP of the present invention, any given protrusion end portion facing the protrusion of an opposing one of the electrodes may be formed such that a contour of the protrusion end portion at a surface parallel to a main surface of the respective band-shaped base is polygonal or curved in shape.

Also, in the PDP of the present invention, in at least one of the first and second electrodes, any two adjacent protrusions of the electrode may protrude an equal distance from the base and form a pair, an end portion of each protrusion in the pair may be formed such that a contour at a surface parallel to a main surface of the base is polygonal or curved in shape, and the protrusions may have any of the features of the following (1) to (3).

(1) The end portions of the protrusions in the pair are inclined with respect to a width direction of the respective band-shaped base such that a point of intersection of center lines of the protrusions in the pair is further away from the electrode than the protrusion end portions.

(2) A gap between the protrusions constituting each of the pairs of protrusions is narrower on a protrusion end side than on a base side.

(3) End portions of the protrusions constituting the pair are formed so as to be curved toward each other.

Also, in the PDP of the present invention, each of the first and second electrodes includes a band-shaped base and a protrusion protruding from the base toward the base of the other one of the electrodes in the pair, each of the bases is composed of a bus electrode and a transparent electrode, ends of the protrusions of the first and second electrodes are formed such that a contour at a surface parallel to the main surface of the base is acutely angled or curved, and the protrusions of the first and second electrodes extend from the bus electrodes, and are formed from a same type of material as the bus electrodes.

EFFECTS OF THE INVENTION

As described above, in the plasma display panel of the present invention, the dielectric layer has a dielectric breakdown voltage of $1.0\times10^6$ [V/cm] to $1.0\times10^7$ [V/cm] inclusive, and since the dielectric layer of a conventional PDP has a dielectric breakdown voltage of approximately $2.5\times10^5$ [V/cm], the dielectric layer can be made thinner than in a conventional PDP while maintaining a high withstand voltage.

As such, in the PDP of the present invention, the dielectric layer is thinner than in a conventional PDP, thereby enabling an improvement in electric field intensity, and sustaining discharges can be readily generated even if the discharge sustaining voltage is reduced.

In the plasma display panel pertaining to the present invention, it is therefore possible to reduce the discharge inception voltage and the discharge sustaining voltage while improving luminous efficiency.

In the PDP of the present invention, the dielectric layer may have been formed by a chemical vapor deposition method and include Si atoms and O atoms. This enables an easy improvement in the density of the dielectric layer, and the formation of a denser and thinner dielectric layer than in a conventional PDP, and makes it possible to easily set the range of the dielectric breakdown voltage of the dielectric layer, which is preferable.

In the PDP of the present invention, the dielectric layer maybe have been formed by an inductively-coupled plasma chemical vapor deposition method (ICP-CVD method), which enables the dielectric layer to be formed more quickly than in a conventional PDP, and increases mass productivity, which is preferable.

Also, the relative dielectric constant $\in$ may be in a range of 2 to 5 inclusive, and the film thickness d of the dielectric layer may be in a range of 1 [μm] to 10 [μm] inclusive, which enables the formation of a thinner dielectric layer than in a conventional PDP while maintaining the withstand voltage, and since the dielectric layer is thinner than in a conventional PDP, transmissivity can be improved, and warpage of the substrates can be reduced, which is preferable.

Also, a ratio ($\in$/d) between a relative dielectric constant $\in$ and a film thickness d of the at least one dielectric layer may be in a range of 0.1 to 0.3 inclusive, which enables the suppression of an increase in the electrostatic capacity, and reliably improves luminous efficiency since it is possible to suppress the discharge current from exceeding the amount necessary to generate a sustaining discharge, which is preferable.

Each of the first and second electrodes may include a band-shaped base and a plurality of protrusions protruding from the base toward the base of the other one of the electrodes in the pair, and at least two of the protrusions of the first electrode and of the second electrode may exist in each cell, whereby when power is supplied to the first and second electrodes, in each discharge cell an electric potential is concentrated at the protrusions, and the electric field intensity in the discharge space is improved over a conventional PDP. In this case, the above effects are enhanced.

Consequently, in this case, two or more sites where discharges readily occur can be provided in each discharge cell, and, compared with providing only one pair of protrusions in each discharge cell, the electric field intensity in the discharge space is improved, discharges are more readily generated, and a sustain discharge can be reliably generated even if the discharge inception voltage is lowered. In this case, the above effects are further enhanced.

In particular, in this case, two or more protrusions are provided in each discharge cell, whereby even if there is some misalignment of the protrusions in the direction in which the bases extend, the reliability of sustain discharges is higher than when there is only one pair of protrusions in each discharge cell.

Consequently, in this case, compared with a conventional PDP and a PDP provided with only one pair of protrusions in each discharge cell, the discharge inception voltage for reliably generating a sustain discharge and the discharge sustaining voltage can be lowered, and the power consumption of the PDP can be lowered, which is preferable.

For example, in each of the discharge cells, the protrusions of the first electrode and the second electrode may be arranged so as to oppose each other, and any two opposing protrusions may protrude an equal distance, and adjacent protrusions may protrude an equal distance, and the plurality of protrusions may exist in three or more groups in each of the discharge cells, each group including one of the protrusions of the first electrode and an opposing one of the protrusions of the second electrode, and among the three or more groups, a group of protrusions positioned in a central portion of the discharge cell may protrude a smallest distance, and remaining groups may protrude an increasing distance in accordance with increasing distance from the central portion of the discharge cell, or alternatively, a group of protrusions positioned in a central portion of the discharge cell may protrude a greatest distance, and remaining groups may protrude a decreasing distance in accordance with increasing distance from the central portion of the discharge cell, in which case the above effects are enhanced since the protrusion distances are properly adjusted.

In particular, in this case in which the protrusion distances are adjusted differently at the center portion and at the ends, the aperture ratio of each discharge cell is improved, and the PDP of the present invention can be a high-definition PDP, which is preferable.

Any given protrusion end portion facing the protrusion of an opposing one of the electrodes may be formed such that a contour of the protrusion end portion at a surface parallel to a main surface of the respective band-shaped base is polygonal or curved in shape, whereby when power is supplied to the first and second electrodes to generate a sustain discharge, electric potential is concentrated at the protrusions, and further concentrated at the tips of the protrusions, and the electric field intensity is strengthened in the discharge space. In this case discharges can be reliably generated even when using a low voltage, and two or more sites where discharges are reliably generated are provided, whereby the above effects are enhanced.

Also, in at least one of the electrodes, any two adjacent protrusions of the electrode may protrude an equal distance from the base and form a pair, an end portion of each protrusion in the pair may be formed such that a contour at a surface parallel to a main surface of the base is polygonal or curved in shape, and any of the features of the above (1) to (3) may be provided, whereby an equipotential line is connected between the tips of adjacent protrusions of the same electrode, and the equipotential line juts out toward the other electrode. Since the discharge distance is even shorter in this case, the discharge inception voltage can be lowered even further, whereby the above effects are enhanced.

The tips having the features of any of the above (1) to (3) may be provided such that when the tips are assumed to define vertices of an enclosed area, the enclosed area is a square, whereby an equipotential line is connected between the tips of adjacent protrusions of the same electrode, and the equipotential line juts out toward the other electrode. Since discharges can be most readily generated in this case, the above effects are enhanced.

Also, each of the bus electrodes may include aluminum and neodymium as main components, and have been formed in a vacuum or at a reduced pressure, whereby the resistance and film thickness can be lowered more than in a conventional PDP, differences in the thickness of the dielectric layer can be suppressed even when laminated so as to cover the bus electrodes. The dielectric layer can therefore be formed thinly, and migration which occurs during driving can be suppressed, which is preferable.

At least one of the bases may be constituted from a bus electrode and a transparent electrode, and the plurality of protrusions may extend from the bus electrodes and be formed from a same type of material as the bus electrodes, whereby the protrusions can also be formed at the same time as forming the bus electrodes using the same microfabrication process used when forming the bus electrodes, and the electrical resistance from the bus electrodes to the protrusions can be lowered.

Consequently, in this case, the PDP pertaining to the present invention can be manufactured easily, and the dimensions of the discharge cells can be reduced easily, thereby realizing a PDP with improved response, which is preferable.

Furthermore, each of the first and second electrodes may include a band-shaped base and a protrusion protruding from the base toward the base of the other one of the electrodes in the pair, each of the bases may be composed of a bus electrode and a transparent electrode, ends of the protrusions of the first and second electrodes may be formed such that a contour at a surface parallel to the main surface of the base is an acute-angular shape, and the protrusions of the first and second electrodes may extend from the bus electrodes and be formed from a same type of material as the bus electrodes, whereby electric potential is concentrated at the protrusions, and further concentrated at the tips of the protrusions, and the electric field intensity is strengthened in the discharge space. In this case discharges can be reliably generated even when using a low voltage, whereby the above effects are enhanced.

In this case, the protrusions can be formed at the same time as the bus electrodes, and the electrical resistance from the bus electrodes to the protrusions is lowered, therefore reducing power consumption and enabling the PDP to be high-definition.

The protective film may include MgO as a main component, be laminated on the main surface of the respective dielectric layer on the discharge space side in a vacuum or at a reduced pressure, and be stored in the vacuum or at the reduced pressure until the pair of substrates were joined together, which compared to a conventional PDP, suppresses the presence of impurities in the protective layer, thereby improving the secondary electron emission coefficient and the sputter resistance of the protective film, and reducing the discharge inception voltage even further improves the sputter resistance of the protective film, thereby further improving luminous efficiency and reliability, which is preferable.

The substrate may have a thickness t in a range of 0.5 [mm] to 1.1 [mm] inclusive, which enables a thinner and lighter weight PDP than a conventional PDP, and the substrate may be composed of a plastic material, thereby further reducing the weight of the PDP, which is preferable.

Also, in a manufacturing method for the PDP of the present invention, a reduced pressure state is maintained from the dielectric layer lamination step until the dielectric layer-laminated substrate transportation/storage step, or a reduced pressure state is maintained from the protective film lamination step until the protective film-laminated substrate transportation/storage step, whereby the dielectric layer and the protective film are formed without coming into contact with air, that is to say, the adsorption of impure gases can be suppressed over a conventional manufacturing method for a PDP.

Moreover, in the manufacturing method for the PDP of the present invention, the manufacturing process is simpler than in the manufacturing method for the PDP of patent document 1, and the quality and reliability of the PDP of the present invention are improved.

This, compared with a conventional PDP, enables the manufacture of a PDP with a long life, high reliability, and stable quality.

The substrate may be the front substrate, whereby the dielectric layer and protective film formed on the front substrate do not absorb impure gases, and the above effects are enhanced since the front plate in particular greatly contribute to the shortening of the life of the PDP.

The manufacturing method for the PDP of the present invention may further include the step of forming a display electrode on the main surface of the substrate, wherein the display electrode formation step is performed before the dielectric layer lamination step, and includes the substeps of forming a band-shaped transparent electrode; and forming a band-shaped bus electrode on a main surface of the transparent electrode, and in the bus electrode formation substep, the bus electrode is formed using a material including aluminum and neodymium as main components and by a vacuum film-formation method, whereby a thin bus electrode can be formed since the resistance of the bus electrode can be made smaller than in a conventional PDP due to being formed from a material that includes aluminum and neodymium as the main components. In this case, differences in the thickness distribution of the dielectric layer can be suppressed even when formed so as to cover the bus electrodes, and dielectric breakdown in the dielectric layer can be suppressed, whereby the above effects are enhanced.

Also, the bus electrode can be formed by a low temperature process due to using a material that includes aluminum and neodymium as the main components, and the above-mentioned vacuum deposition process is a low temperature process, which is preferable. Also, the low temperature process can be performed when patterning the bus electrode by a drying etching method since the material includes aluminum, which is preferable.

Also, in this case, the bus electrode is formed using a vacuum deposition method, which due to being a low temperature process, enables the suppression of warpage and cracks in the substrates that occur when using a high temperature process, whereby the above effects are enhanced.

In the protective film lamination step, the protective film may be laminated using a material including Mg atoms and O atoms as main components and by a vacuum film-formation method, which enables the suppression of warpage and cracks in the substrates that occur when using a high temperature process since the vacuum deposition process is a low temperature, whereby the above effects are enhanced.

The substrate may be a back substrate, the manufacturing method may further include the steps of: before the dielectric layer lamination step, forming a data electrode on the main surface of the back substrate; after transportation in the dielectric layer-laminated substrate transportation/storage step, providing barrier ribs so as to be upright on a main surface of the dielectric layer; and forming a phosphor layer on side surfaces of the barrier ribs and on the main surface of the dielectric layer, and the reduced pressure state may be maintained from the dielectric layer lamination step until the phosphor layer formation step, whereby the dielectric layer formed on the back substrate does not absorb impure gases, and the above effects are enhanced.

In the data electrode formation step, the data electrode may be formed using a material including aluminum and neodymium as main components and by a vacuum film-formation method, whereby a thin data electrode can be formed as a result of having a lower resistance than in a conventional PDP since the bus electrode is formed using a material that includes aluminum and neodymium as the main components. In this case, differences in the thickness distribution of the dielectric layer can be suppressed even when formed so as to cover the data electrode, and dielectric breakdown in the dielectric layer can be suppressed, whereby the above effects are enhanced Also, the data electrode can be formed by a low temperature process due to using a material that includes aluminum and neodymium as the main components, and the above-mentioned vacuum deposition process is a low temperature process, which is preferable. Also, the low temperature process can be performed when patterning the data electrode by a drying etching method since the material includes aluminum, which is preferable.

Also, in this case, the data electrode is formed using a vacuum deposition method, which due to being a low temperature process, enables the suppression of warpage and cracks in the substrates that occur when using a high temperature process, whereby the above effects are enhanced.

The steps of the manufacturing method for the PDP of the present invention may be performed in an atmosphere at room temperature to 300 [° C.] inclusive, whereby warpage and cracks in the panel are reliably suppressed, which is preferable. Also, in the steps, compared with a conventional manufacturing method for a PDP, the manufacturing time and power consumption during manufacturing are reduced, and the range of wiring materials that may be selected can be widened.

In the dielectric layer lamination step, the dielectric layer may be laminated using a chemical vapor deposition method, thereby enabling the lamination of a dielectric layer with a higher density, more elaborate structure, and higher dielectric breakdown voltage than in a conventional manufacturing method for a PDP. This enables the easy manufacture of a PDP that includes a dielectric layer with a dielectric breakdown voltage in the above-mentioned ranged.

Consequently, this enables the lamination of a thinner dielectric layer than in a conventional manufacturing method for a PDP, and the manufacture of a PDP in which the electric field in the discharge space is stronger during driving than in a conventional PDP. This enables the manufacture of a PDP with a lowered discharge sustain voltage and discharge inception voltage, and with a high discharge efficiency, which is preferable.

The chemical vapor deposition method may be an ICP-CVD method, thereby enabling the high-speed lamination of the dielectric layer, which is preferable.

In the PDP of the present invention, each of the first and second electrodes may include a band-shaped base and a plurality of protrusions protruding from the base toward the base of the other one of the electrodes in the pair, and at least two of the protrusions of the first electrode and of the second electrode may exist in each cell, whereby when power is supplied to the first and second electrodes, in each discharge cell an electric potential is concentrated at the protrusions, and the electric field intensity in the discharge space is improved over a conventional PDP.

Consequently, in the PDP of the present invention, two or more sites where discharges readily occur can be provided in each discharge cell, and, compared with providing only one pair of protrusions in each discharge cell, the electric field intensity in the discharge space is improved, and discharges are more readily generated.

As a result, in the PDP of the present invention, a sustain discharge can be reliably generated even if the discharge inception voltage is lowered, and the discharge inception voltage and discharge sustaining voltage can be lowered.

In particular, in the PDP of the present invention, two or more protrusions are provided in each discharge cell, whereby even if there is some misalignment of the protrusions in the direction in which the bases extend, the reliability of sustain discharges is higher than when there is only one pair of protrusions in each discharge cell.

Consequently, in the PDP of the present invention, compared with a conventional PDP and a PDP provided with only one pair of protrusions in each discharge cell, the discharge inception voltage for reliably generating a sustain discharge and the discharge sustaining voltage can be lowered, and the power consumption of the PDP can be lowered.

For example, in each of the discharge cells, the protrusions of the first electrode and the second electrode may be arranged so as to oppose each other, and any two opposing protrusions may protrude an equal distance, and adjacent protrusions may protrude an equal distance, and the plurality of protrusions may exist in three or more groups in each of the discharge cells, each group including one of the protrusions of the first electrode and an opposing one of the protrusions of the second electrode, and among the three or more groups, a group of protrusions positioned in a central portion of the discharge cell may protrude a smallest distance, and remaining groups may protrude an increasing distance in accordance with increasing distance from the central portion of the discharge cell, or alternatively, a group of protrusions positioned in a central portion of the discharge cell may protrude a greatest distance, and remaining groups may protrude a decreasing distance in accordance with increasing distance from the central portion of the discharge cell, in which case the above effects are enhanced since the protrusion distances are properly adjusted.

In particular, in this case in which the protrusion distances are adjusted differently at the center portion and at the ends, the aperture ratio of each discharge cell is improved, and the PDP of the present invention can be a high-definition PDP, which is preferable.

Any given protrusion end portion facing the protrusion of an opposing one of the electrodes may be formed such that a contour of the protrusion end portion at a surface parallel to a main surface of the respective band-shaped base is polygonal or curved in shape, whereby when power is supplied to the first and second electrodes to generate a sustain discharge, electric potential is concentrated at the protrusions, and further concentrated at the tips of the protrusions. In this case discharges can be reliably generated even when using a low voltage, and two or more sites where discharges are reliably generated are provided, whereby the above effects are enhanced.

Also, in at least one of the electrodes, any two adjacent protrusions of the electrode may protrude an equal distance from the base and form a pair, an end portion of each protrusion in the pair may be formed such that a contour at a surface parallel to a main surface of the base is polygonal or curved in shape, and any of the features of the above (1) to (3) may be provided, whereby an equipotential line is connected between the tips of adjacent protrusions of the same electrode, and the equipotential line juts out toward the other electrode. Since the discharge distance between different electrodes is even shorter in this case, the discharge inception voltage can be lowered even further, whereby the above effects are enhanced.

The tips having the features of any of the above (1) to (3) may be provided such that when the tips are assumed to define vertices of an enclosed area, the enclosed area is a square, whereby an equipotential line is connected between the tips of adjacent protrusions of the same electrode, and the equipotential line juts out toward the other electrode. Since discharges can be most readily generated in this case, the above effects are enhanced.

At least one of the bases may be constituted from a bus electrode and a transparent electrode, and the plurality of protrusions may extend from the bus electrodes and be formed from a same type of material as the bus electrodes, whereby the protrusions can also be formed at the same time as forming the bus electrodes using the same microfabrication process used when forming the bus electrodes, and the electrical resistance from the bus electrodes to the protrusions can be lowered.

Consequently, in this case, the PDP pertaining to the present invention can be manufactured easily, and the dimensions of the discharge cells can be reduced easily, thereby realizing a PDP with improved response and the above effects.

Furthermore, each of the first and second electrodes may include a band-shaped base and a protrusion protruding from the base toward the base of the other one of the electrodes in the pair, each of the bases may be composed of a bus electrode and a transparent electrode, ends of the protrusions of the first and second electrodes may be formed such that a contour at a surface parallel to the main surface of the base is an acute-angular shape, and the protrusions of the first and second electrodes may extend from the bus electrodes and be formed from a same type of material as the bus electrodes, whereby electric potential is concentrated at the protrusions, and further concentrated at the tips of the protrusions, and the electric field intensity is strengthened in the discharge space. In this case discharges can be reliably generated even when using a low voltage, the protrusions can be formed at the same time as the bus electrodes, and the electrical resistance from the bus electrodes to the protrusion tips can be lowered.

In the PDP of the present invention, it is therefore possible to reduce power consumption and have high definition.

Note that the structures of the present invention as described above can be combined with each other as long as such combination does not diverge from the purpose of the present invention.

BEST MODE FOR CARRYING OUT THE INVENTION

Embodiments of the present invention are described below with reference to the drawings.

Embodiment 1

Figure 1A:
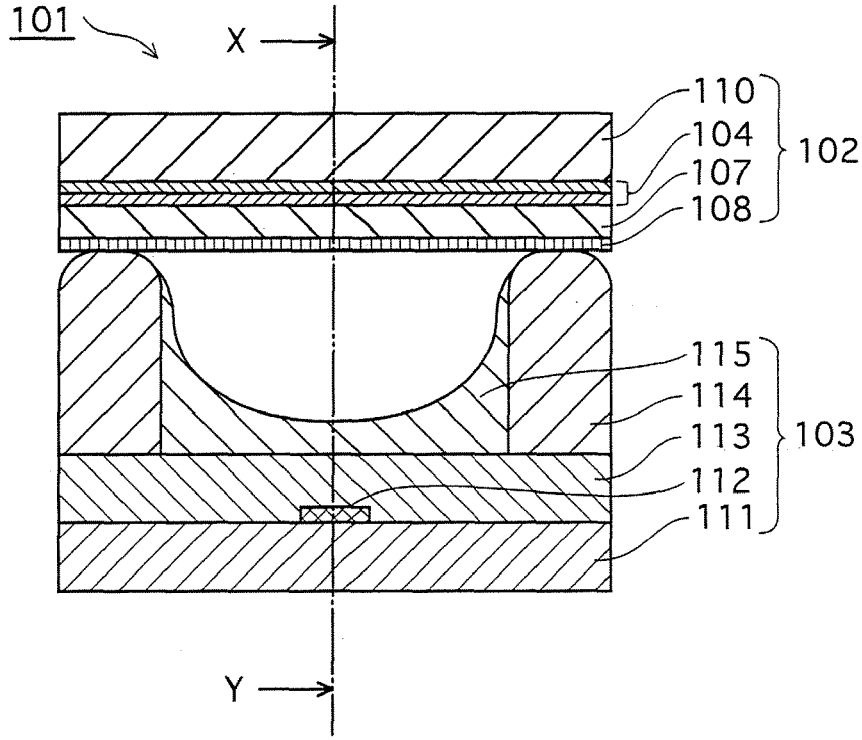
FIGS. 1A and 1B are conceptual cross-sectional diagrams showing a structure of a discharge cell of a PDP 1 pertaining to embodiment 1 of the present invention.
Figure 1B:
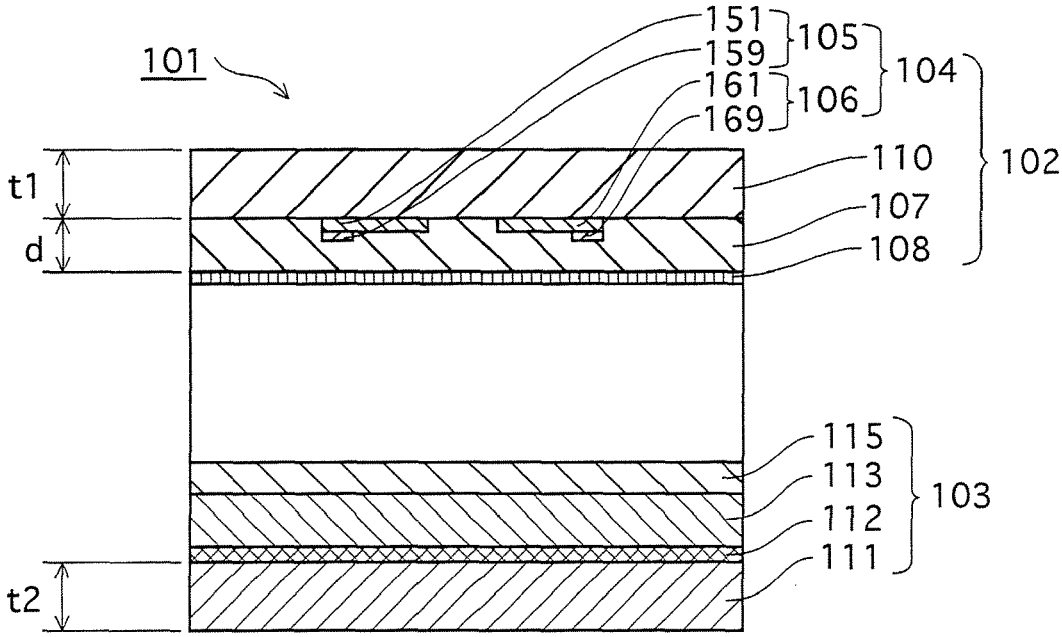

FIG. 1A shows a cross section of a unit discharge cell of a PDP 101 in embodiment 1 of the present invention, taken along barrier rib 114 that has been cut vertically, and FIG. 1B shows a cross section taken along X-Y in FIG. 1A. Note that although FIG. 1 shows only the unit discharge cell for the sake of simplicity, a plurality of discharge cells emitting red, green and blue light are disposed in a matrix configuration in the PDP of embodiment 1.

1. Structure of the PDP 101

As shown in FIG. 1A, the PDP 101 includes a front plate 102 and a back plate 103 that are disposed in opposition. The front plate 102 of the PDP 101 includes a thin substrate 110, a display electrode pair 104 formed on a main surface of the thin substrate 110, and a dielectric layer 107 and a protective film 108 that have been laminated in the stated order so as to cover the main surface of the substrate 110. The substrate 110 is composed of, for example, a glass material, and has a thickness of approximately 1.1 [mm].

As shown in FIG. 1B, the display electrode pair 104 includes a scan electrode 105 and a sustain electrode 106 that together form a pair, are disposed in opposition to sandwich a gap of, for example, 50 [μm] to 100 [μm] therebetween, and are provided in a stripe configuration.

The scan electrode 105 and the sustain electrode 106 are formed by patterning transparent electrodes 151 and 161 respectively on the main surface of the substrate 110 in a wide band configuration, the transparent electrodes 151 and 161 being composed of ITO (indium-tin oxide) and having a relatively high resistance and a film thickness set to, for example, approximately 100 [nm].

The main component of the transparent electrodes 151 and 161 may be $SnO_2$ (tin oxide), ZnO (zinc oxide), or the like.

In order to lower the electrical resistance of the transparent electrodes 151 and 161 of the scan electrode 105 and the sustain electrode 106, bus electrodes 159 and 169 that include, for example, Al—Nd (aluminum-neodymium) as a main component are disposed on main surfaces of the transparent electrodes 151 and 161.

The bus electrodes 159 and 169 are disposed in a narrower configuration than the transparent electrodes 151 and 161.

The bus electrodes 159 and 169 are not limited to this, but rather may include at least Al and a rare earth metal as main components.

A thickness of the bus electrodes 159 and 169 is set to approximately 1 [μm].

In the present embodiment, the thickness of the bus electrodes 159 and 169 can be easily set to the above value since they are constituted from an Al series metal alloy thin film formed by a sputtering method and patterned by a dry etching method.

The bus electrodes 159 and 169 are not limited to this, but rather may be formed from layers of films by a vacuum film formation process, and be patterned by a photo etching method.

Here, the vacuum film formation process refers to a process of forming thin films in a vacuum, and includes a vacuum vapor deposition method, an electron beam vapor deposition method, a plasma beam vapor deposition method, chemical vapor deposition methods (CVD methods), a sputtering method, and the like.

The bus electrodes 159 and 169 are disposed substantially parallel to each other, similarly to the transparent electrodes 151 and 161.

The bus electrodes 159 and 169 are thinner than in a conventional PDP, and in contrast to a metal that includes Ag as the main component, a metal including Al—Nd as the main component is more homogenous and has superior electrical properties (low resistance). Due to including Al—Nd as the main component, the bus electrodes 159 and 169 can maintain the same performance as bus electrodes of a conventional PDP panel which include Ag as the component, even when the bus electrodes 159 and 169 are thin.

The bus electrodes 159 and 169 of the PDP of the present embodiment are thinner than in conventional PDPs, thereby enabling the suppression of differences in the thickness of the dielectric layer 107 that is laminated so as to cover the bus electrodes 159 and 169, which makes it possible to suppress the thickness of the dielectric layer 107 at edge portions of the bus electrodes 159 and 169 from being less than the thickness of other portions of the dielectric layer 107.

Also, the PDP of the present embodiment has a longer life and higher reliability than conventional PDPs since a so-called migration phenomenon in which metals electrically move during driving of the PDP does not readily occur between the dielectric layer 107 and the bus electrodes 159 and 169 that include Al—Nd as the main component.

The dielectric layer 107 has a memory, which is a current restricting function unique to AC PDPs. Also, the dielectric layer 107 has a relative dielectric constant ∈ set to approximately 4, a thickness d set to approximately 5 [μm], and is composed of, for example, a material including 95% $SiO_2$.

The relative dielectric constant ∈ of the dielectric layer 107 is not limited to this, but rather it is sufficient to be set in the range of 2 to 5 inclusive.

Generally, the relative dielectric constant ∈ is in the range of 4 to 5 inclusive when the dielectric layer 107 includes $SiO_2$ as a main component and is laminated using a CVD method, but falls in the range of 2 to 3 inclusive when the dielectric layer 107 is formed using a so-called low-k material.

Also, due to the relationship with the thickness d, the electrostatic capacity of the dielectric layer 107 will be small, and a necessary discharge current will not be accumulated if the relative dielectric constant ∈ is less than 2, while on the other hand, if greater than 5, an excess of discharge current will be generated, thereby reducing luminous efficiency.

It is sufficient to use SiOC, SiOF or the like as the so-called low-k material, in order to form the dielectric layer 107 with a relative dielectric constant ∈ in the range of 2 to 3 inclusive.

The so-called low-k material used in the dielectric layer 107 is not limited to this, but rather it is sufficient for the material to enable the setting of the relative dielectric constant in the aforementioned range, and enable the formation of the film by any of various types of CVD methods.

The thickness d of the dielectric layer 107 is not limited to this, but rather it is sufficient to be set in the range of 1 [μm] to 10 [μm] inclusive.

The dielectric breakdown voltage strength becomes insufficient and yield is reduced if the thickness d of the dielectric layer 107 is less than 1 [μm], while a sufficient reduction in discharge inception voltage and discharge sustaining voltage cannot be obtained if the thickness d is greater than 10 [μm].

The dielectric layer 107 includes $SiO_2$, and has a higher dielectric breakdown voltage and denser layer structure than in conventional PDPs.

The dielectric layer 107 has a higher dielectric breakdown voltage and a denser layer structure than in conventional PDPs because in the lamination process, the dielectric layer 107 is formed by any of various types of CVD methods such as the inductive coupling plasmas CVD method (ICP-CV method), and using tetra-ethyl-oxysilane (TEOS) and a dielectric layer material including Si atoms and O atoms.

It is desirable for the dielectric breakdown voltage of the dielectric layer 107 to be $1.0\times10^6$ [V/cm] to $1.0\times10^7$ [V/cm] inclusive.

It is not desirable for the dielectric breakdown voltage to be greater than that of the bulk material of glass, which is around $1.0\times10^7$ [V/cm]. Also, dielectric breakdown may occur if the dielectric breakdown voltage is less than $1.0\times10^6$ [V/cm], since the thickness d of the dielectric layer 107 has an upper limit of 10 [μm], which is ¼ that of conventional dielectric layers (d=40 [μm]), whereby dielectric breakdown voltage falls below $1.0\times10^6$ [V/cm], which is four times the dielectric breakdown voltage of conventional dielectric layers ($2.5\times10^5$ [V/cm]).

It is preferable for the dielectric layer 107 to include 80% to 100% $SiO_2$ since density further increases, the layer structure becomes denser, and the dielectric breakdown voltage increases in such a case.

Given that the dielectric layer 107 has a high dielectric breakdown voltage and a dense layer structure, a sufficient dielectric breakdown voltage can be maintained if the relative dielectric constant ∈ is in the range of 2 to 5 inclusive, even if the thickness d of the dielectric layer 107 is reduced over conventional PDPs to be in the range of 1 [μm] to 10 [μm] inclusive.

The thickness d of the dielectric layer 107 can be set to approximately 10 [μm] if the relative dielectric constant ∈ is close to 5, and to approximately 5 [μm] if the relative dielectric constant ∈ is close to 3, thereby obtaining a practical withstand voltage, and furthermore, the thickness d may be further reduced to, for example, approximately 1 [μm] if the thickness of the bus electrodes 159 and 169 is further reduced.

However, since the capacitance c increases if the thickness d of the dielectric layer 107 is reduced too much, more discharge current is generated than is necessary to generate a sustain discharge, and luminous efficiency is reduced.

In the present embodiment, the ratio of the relative dielectric constant ∈ to the thickness d of the dielectric layer 107 (∈/d) is set to 0.1 to 0.3 inclusive.

An improvement in luminous efficiency cannot be expected if (∈/d) is greater than 0.3 since this is greater than the conventional PDP (∈/d) of 0.3, and it is difficult to set (∈/d) to less than 0.1 in view of the facts that it is difficult to form a film with a thickness d greater than 20 [μm] when using a CVD method, and that the lower limit of the relative dielectric constant ∈ is 2.

A technique exists for increasing the Xe partial pressure in the discharge gas in order to improve luminous efficiency, but this technique requires that a high electrical energy be supplied to the Xe, that the discharge sustain voltage be increased, and that a driver IC with a higher withstand voltage than a driver IC connected to conventional PDPs be provided. In the present embodiment, the electric field intensity in the discharge space when a voltage is applied to the display electrode pair 104 is strengthened since the thickness d of the dielectric layer 107 is smaller than in conventional PDPs, and since the electric energy density increases, the driver IC connected to conventional PDPs can be used while increasing the Xe partial pressure in the discharge gas without increasing the discharge sustain voltage.

In the PDP 101 of the present embodiment, it is possible to improve the transmission of visible light through the front plate 102 generated by driving of the PDP over conventional PDPs since the layer structure of the dielectric layer 107 is denser and the thickness d of the dielectric layer 107 is smaller than in conventional PDPs.

Furthermore, given that the thickness d of the dielectric layer 107 is smaller in the present embodiment than in conventional PDPs, it is possible to reduce the occurrence of warpage in the substrate due to differences in thermal expansion between the glass substrate 110 and the main surface of the dielectric layer 107 laminated thereon during the heating process in the panel assembly step, thereby improving the lifetime and quality of the PDP.

Also, a thin and light PDP can be obtained since in the present embodiment, a thickness t1 of the substrate 110, which is approximately 1.1 [mm], is smaller than in conventional PDPs.

Also, given that the dielectric layer 107 is formed by a CVD method so as to cover the display electrode pair 104 including the bus electrodes 159 and 169 in the present embodiment, the PDP of the present embodiment is superior to conventional PDPs in that the dielectric layer 107 is formed along the contour of the display electrode pair 104, and the thickness d of the dielectric layer 107 is even. Also, it is possible to suppress the thickness d from becoming smaller at areas of the dielectric layer 107 that correspond to the electrode edges, thereby improving the withstand voltage of the dielectric layer 107.

The protective film 108 has a thickness of, for example, 0.6 [μm], is laminated on the main surface of the dielectric layer 107 facing the discharge space, and includes MgO as a main component.

MgO (magnesium oxide) is widely used as a material in the protective film 108 due to having a large secondary electron emission coefficient γ and high sputter resistance, and being optically transparent.

The surface of the protective film 108 is exposed to the discharge space, and protects the dielectric layer 107 from ion bombardment during discharges when the assuming that the PDP is in the driven state, and also acts to lower the discharge inception voltage by efficiently emitting secondary electrons.

The dielectric layer 107 and the protective film 108 act to prevent sputtering and degredation of the surface of the display electrode pair 104 due to high energy ions generated by discharges.

The thickness of the protective film 108 is not limited to this, but rather it is sufficient to be 0.4 [μm] to 1.0 [μm] inclusive.

Sputter resistance is reduced if the thickness of the protective film 108 is less than 0.4 [μm], whereas the efficient emission of secondary electrons is no longer possible when the thickness is greater than 1.0 [μm].

The protective film 108 has a higher secondary electron emission coefficient and a higher sputter resistance than conventional PDPs.

Given that the protective film 108 is kept in a reduced-pressure atmosphere from after formation of the dielectric layer 107 covering the display electrode pair 104 until formation of the protective film 108 is completed, the absorption of impure gases in the process for forming the protective film 108 is suppressed more than in conventional PDPs.

Here, the reduced-pressure state refers to a vacuum or a reduced-pressure vacuum, or a reduced-pressure state replaced with an inert gas.

When formed in a vacuum using a vacuum film formation process described later, such as a vacuum deposition method, the protective film 108 has a dense layer structure, further increased secondary electron emission coefficient, and high sputter resistance, which is preferable.

If the front plate 102 is placed in a reduced-pressure atmosphere until sealing of the front place 102 and the back plate 103 is completed, the absorption of impure gases by the protective film 108 can be further suppressed, and the secondary electron emission coefficient and sputter resistance of the protective film 108 can be increased over conventional PDPs, which is preferable. Also, constituent elements formed on the main surface of the front plate 102 such as the barrier ribs and phosphor layers do not absorb impure gases, and it is possible to further suppress the absorption of impurities by the dielectric layer 107 and the protective film 108, which is preferable.

On the other hand, on the back plate 103, a data (address) electrode 112 is formed in the unit discharge cell on the surface of the substrate 111 formed, from a glass plate, so as to three-dimensionally cross the scan electrode 105 and the sustain electrode 106 provided on the surface of the front plate 102.

The data electrode 112 includes at least Al—Nd, and is formed by a vacuum film formation process, similarly to the formation of the display electrode pair 104 on the front plate 102.

Furthermore, a dielectric layer 113 with a film thickness of approximately 2 [μm] is formed on the surface of the substrate 111 so as to cover the data electrode 112 formed thereon.

Similarly to the above-described dielectric layer 107 on the front plate 102, the dielectric layer 113 includes 80% $SiO_2$ and is formed using any of various CVD methods such as the CVD method and the ICP-CVD method.

Furthermore, although not depicted in FIG. 1B, barrier ribs 114 are formed upright on the main surface of the dielectric layer 113 so as to have substantially even heights.

The barrier ribs 114 preferably include a non lead-based glass that is applied and baked, and is formed into a rib configuration in a predetermined pattern so as to divide a plurality of discharge cells into stripes or a lattice formation (not depicted).

Also, red, green, and blue light emitting phosphor layers 115 are formed on the main surface of the dielectric layer 113 and the wall surfaces of the barriers walls 114.

Phosphors such as $(Y,Gd)BO_3$:Eu, $Zn_2SiO_4$:Mn or $BaMg_2Al_{14}O_{24}$:Eu are used in the phosphor layers 115.

The phosphor layers 115 are applied per aforementioned phosphor color by being printed and baked, and are formed on the side walls of the barrier ribs 114 and on the main surface of the dielectric layer 113 on the substrate 111.

Although not described in detail, the front plate 102 formed by the aforementioned process and the back plate 103 formed by the aforementioned vacuum process are disposed in opposition, the edges thereof are sealed, the space separated from the exterior by the front and back plates 102 and 103 and a sealant not depicted is evacuated to create a high-vacuum therein, and a mixed discharge gas including mainly the rare gases xenon and neon is filled and enclosed in the space at a pressure of approximately 60 [kPa]. This completes the PDP of the present invention.

The discharge gas is not limited to this, but rather may include xenon and barium as main components.

Neither the phosphor materials, the discharge gas components, nor the pressure of the discharge gas are limited to as previously described, but rather may be materials and conditions commonly used in AC PDPs.

The scan electrode 105, the sustain electrode 106 and the data electrode 112 of the PDP disposed with a plurality of the unit discharge cells shown in FIG. 1 are connected to a drive circuit (driver IC etc.), and the drive circuit is connected to a control circuit for control thereof, thereby obtaining a PDP apparatus.

2. Driving Method for the PDP 101

The PDP is driven by an address-display separation drive scheme that includes three operation periods (not depicted), which are specifically (1) an initialization period in which all display cells are put into an initialized state, (2) a data writing period in which the discharge cells are addressed, and display states corresponding to input data are selected and input to the addressed discharge cells, and (3) a sustained discharge period in which the discharge cells in the display states are caused to perform display emission.

In (1) the initialization period, which is usually performed at least once in a frame period, a 400 [V] to 600 [V] high voltage is applied between the scan electrode 105 and the data electrode 112 to place the wall charge of the all the display cells into the initialized state level.

In (2) the data write period in subfield periods, write data is input using the data electrode 112 of the back plate 103 to form a wall charge on the main surfaces, on the discharge space side, of the dielectric layer 107 and the protective film 108 of the front plate 102 in opposition to the back plate 103.

In (3) the sustain discharge period, rectangular electrode voltage pulses having mutually different phases are applied to the scan electrode 105 and the sustain electrode 106 on the front plate 102. In other words, an alternating voltage is applied to the scan electrode 105 and sustain electrode 106 to generate a pulse discharge each time the current polarity changes in discharge cells to which display state data has been written. Sustain discharges generated in this way cause 147-[nm] resonance lines to be emitted from exited xenon atoms in the discharge space, and mainly 173-[nm] molecular beams to be emitted from excited xenon molecules, after which, such ultraviolet radiation is converted into visible radiation by the phosphor layers 115 provided on the back plate 103, thereby obtaining display luminance by the driving of the PDP 101.

Effects of the PDP of Embodiment 1

In the PDP 101 of the present embodiment, the density of the dielectric layer 107 is improved over a dielectric layer formed by a conventional pressure film process since the dielectric layer 107 includes $SiO_2$ and is formed by a CVD method, and therefore the dielectric layer 107 has a high dielectric breakdown voltage of $1.0\times10^6$ [V/cm] or more, compared to a conventional dielectric layer.

In the PDP 101 of the present embodiment, binder baking material does not remain in the bus electrodes 159 and 169 after baking, in contrast to bus electrodes formed by a conventional thick film process including a baking step, due to the bus electrodes 159 and 169 being formed by a vacuum film formation process, and therefore, gas bubbles do not readily form in the contact portions of the bus electrodes 159 and 169 and the dielectric layer 107 formed by a CVD method so as to cover the bus electrodes 159 and 169.

Also, in the PDP 101 of the present embodiment, the bus electrodes 159 and 169 are thinner than conventional bus electrodes due to being formed by a vacuum film formation process, whereby differences in thickness of the dielectric layer 107 formed on the bus electrodes 159 and 169 can be suppressed more so than in conventional PDPs, and as a result, the thickness of the dielectric layer 107 at portions corresponding to edge portions of the bus electrodes 159 and 169 can be kept from becoming thinner than other portions of the dielectric layer 107, and dielectric breakdown at portions of the dielectric layer 107 corresponding to edge portions of the bus electrodes 159 and 169 can be suppressed more so than in conventional PDPs. Moreover, given that differences in the thickness of the dielectric layer 107 are suppressed more so than in conventional PDPs, the need to thicken the dielectric layer to maintain the dielectric breakdown voltage is eliminated, and the dielectric layer can be made thinner.

Also, in the PDP 101 of the present embodiment, the thickness of the dielectric layer 107 is more even than in conventional PDPs due to being formed by a CVD method, whereby differences in the film thickness distribution of the dielectric layer 107 is suppressed more so than in conventional PDPs, and as a result, the thickness of the dielectric layer 107 corresponding to edge portions of the bus electrodes 159 and 169 can be kept from becoming thinner than other portions of the dielectric layer 107, and dielectric breakdown at portions of the dielectric layer 107 corresponding to edge portions of the bus electrodes 159 and 169 can be suppressed more so than in conventional PDPs.

As such, in the PDP 101 of the present embodiment, even when the film thickness of the dielectric layer 107 is reduced over conventional dielectric layers, the dielectric layer 107 has a high withstand voltage, gas bubbles do not readily form, and differences in the thickness distribution are reduced, thereby suppressing dielectric breakdown in the dielectric layer 107 more so than in conventional PDPs.

In the PDP of the present embodiment, a thin and dense dielectric layer can be formed more easily than in conventional PDPs since the dielectric layer 107 is formed by a CVD method.

Furthermore, in the PDP 101 of the present embodiment, the electric field intensity between the scan electrode 105 and the sustain electrode 106 is strengthened during driving of the PDP more so than in conventional PDPs since the dielectric layer 107 is thinner than conventional dielectric layers.

Consequently, in the PDP of the present embodiment, driving can be performed using a low sustain discharge voltage, and the discharge inception voltage is reduced, thereby enabling an improvement in luminous efficiency.

Also, in the PDP 101 of the present embodiment, there is no absorption of gas impurities or reactions with gas impurities in the dielectric layers 107 and 113 or the protective film 108 since they are formed in at least a vacuum or reduced-pressure environment.

Therefore, in the PDP of the present embodiment, given that there is no reduction in the secondary electron emission coefficient compared to conventional PDPs, neither the discharge inception voltage nor the discharge sustain voltage rise, and the lifetime and reliability of the PDP can be improved over conventional PDPs without a reduction in sputter resistance.

Note that although the protective film 108 is described above as being composed of MgO, a protective film composed of another metal oxide such as CaO, BaO, SrO, MgNO or ZnO may be used.

Also, although the substrates 110 and 111 are described above as having thicknesses t1 and t2 of approximately 1.1 [mm], warpage of the substrates 110 and 111 can be suppressed even if the thicknesses thereof are set to approximately 0.5 [mm] or 0.7 [mm] since in the PDP 101 of the present embodiment, the bus electrodes 159 and 169 and the dielectric layers 107 and 113 are thinner than bus electrodes and dielectric layers of conventional PDPs. As a result, the substrates 110 and 111 are made thinner, thereby enabling the realization of a thinner and lighter-weight PDP 101 of the present embodiment.

Also, although described above as having thicknesses t1 and t2 of approximately 1.1 [mm], the substrates 110 and 111 may be thicker, and may be set to approximately 2.8 [mm], which is the same as in conventional PDPs.

Also, although glass substrates are used as the substrates 110 and 111 in the above descriptions, the present invention is similarly obtainable if plastic substrates are used. Thermal resistant plastic substrates include, for example, the high heat resistant plastic substrate SUMILITE FST polyethersulfone (PES) (registered trademark of Sumitomo Bakelite Co., Ltd.) manufactured by Sumitomo Bakelite Co., Ltd., with a Tg of approximately 223 [° C.], which as an upper temperature limit is sufficient for use in the low temperature process of the present invention.

Also, although described above as being formed by a CVD method, the dielectric layer 113 of the back plate 103 may be formed by printing and baking a low melting glass, the same as with conventional back plates.

Also, although described above as including Al—Nd and being formed in a vacuum, the data electrode 112 may include Ag as a main component and be formed by being printed and baked, or may include Cr—Cu—Cr as a main component and be formed in a vacuum, the same as with conventional back plates.

Also, although in the above description at least the bus electrodes 159 and 169, the dielectric layer 107 and the protective film 108 are formed on the front plate 102, and at least the data electrode 112 and the dielectric layer 113 are formed on the back plate 103, the present invention is similarly applicable if the layers and films are disposed in the opposite order, such as in a reflective PDP.

Evaluation Test

In the following, there were prepared a working example 1 PDP based on the PDP 101 of the present embodiment, and a comparative example 1 PDP based on a conventional PDP, and the previously described effects were examined.

WORKING EXAMPLE 1

A description of the PDP of working example 1 has been omitted since it is the same as the PDP shown in embodiment 1.

WORKING EXAMPLE 2

A description of the PDP of working example 2 has been omitted since it is the same as the PDP shown in working example 1, other than the relative dielectric constant ∈ and thickness d of the dielectric layer 107 being set to 2.3 and 10 [μm] respectively.

COMPARATIVE EXAMPLE 1

The PDP of comparative example 1 differs from the PDP of working example 1 in that, in the front plate 102, the thickness of the substrate 110 is set to approximately 2.8 [mm], narrow bus electrodes 159 and 169 with a film thickness of approximately 5 [μm] to 6 [μm] are formed by a pressure film processing of applying a layer of Ag paste and performing baking, and the dielectric layer 107 is formed by a printing method of applying a low melting glass material and performing baking, so as to have a relative dielectric constant ∈ of approximately 13, a film thickness of approximately 40 [μm], and a dielectric breakdown voltage of approximately $2.5\times10^5$ [V/cm], and with respect to the back plate 103, the thickness of the glass substrate 111 is set to approximately 2.8 [mm], and the dielectric layer 113 is formed by a printing method of applying a low melting glass material and performing baking, so as to have a relative dielectric constant ∈ of approximately 13, a film thickness of approximately 40 [μm], and a dielectric breakdown voltage of approximately $2.5\times10^5$ [V/cm]. Descriptions of other aspects of the structure have been omitted.

Content and Results of the Evaluation Test

Test 1

The PDPs of comparative example 1 and working example 1 were connected to respective drive circuits etc., and a discharge sustain voltage applied between the scan electrode 105 and sustain electrode 106 was varied. The results of the examination confirmed that although driving was not stable when the discharge sustain voltage was 180 [V] or less in the PDP of comparative example 1, driving was stable even if the discharge sustain voltage was lowered to approximately 140 [V] in the PDP of working example 1.

It was therefore confirmed by the present test that the discharge inception voltage of the PDP of working example 1 can be reduced.

Test 2

Also, the PDPs of comparative example 1 and working example 1 were each provided with 15 inch test panel, connected to respective drive circuits etc., and driven in the stable driving range obtained in test 1. Upon measuring the luminances of the PDPs using the BM-8 luminance meter manufactured by Irie Co., a luminance of 800 [cd/m$^2$] was observed for the PDP of comparative example 1, while a luminance of 960 [cd/m$^2$] was observed for the PDP of working example 1.

It was therefore confirmed that the luminance of the PDP of working example 1 was improved to approximately 1.2 times that of the PDP of comparative example 1, and transmissivity was improved over that of conventional PDPs due to reducing the thickness of the dielectric layer 107.

In addition to the luminance measurement, a known power meter was used to measure the wattage of the PDPs, and upon substituting the wattages into a known equation, it was found that the luminous efficiency of the PDP of comparative example 1 was 1.5 [lm/w], while the luminous efficiency of the PDP of working example 1 was 2.3 [lm/w], thereby confirming that the luminous efficiency of the PDP of working example 1 was improved to approximately 1.5 times that of the PDP of comparative example 1.

Also, upon continuously driving each of the PDPs in the stable driving areas and measuring the time until the luminance measured by the luminance meter was reduced by half, it was found that the luminance half-life of the PDP of comparative example 1 was approximately 5,000 [h], while the luminance half-life of the PDP of working example 1 was approximately 10,000 [h], thereby confirming that a lifetime twice as long as the PDP of comparative example 1 was obtained for the PDP of working example 1, and reliability was further improved over conventional PDPs.

Furthermore, it was found that during driving of the PDP of working example 1, the thin-film dielectric layer 107 has a sufficient withstand voltage since dielectric breakdown did not occur when the high voltage was applied during the aforementioned initialization period.

The PDP of working example 1 includes the thin substrate 110 whose thickness is ⅓ that of the PDP of comparative example 1, and it was confirmed that it is possible to make the PDP of working example 1 thinner and lighter-weight than the PDP of comparative example 1 since warpage was not seen in the substrate 110.

Test 3

Furthermore, the Xe partial pressure of the discharge gas in the PDPs of comparative example 1 and working example was set to 100%, and the thickness of the dielectric layer in working example 1 was set to 10 [μm], and the PDPs were connected to respective drive circuits the same as in test 1. Upon examining stable driving while varying the discharge sustain voltage, it was confirmed that driving of the PDP of comparative example 1 was stable at 340 [V], while driving of the PDP of working example 1 was stable at 220 [V].

It was therefore confirmed by the present test that, in contrast to conventional PDPs, the discharge sustain voltage did not rise even if the Xe partial pressure in the discharge gas is increased.

Test 4

The (∈/d) of the PDP of comparative example 1 was set to 0.32 (relative dielectric constant ∈=12 and thickness d=38 [μm]), and the (∈/d) of the PDP of working example 2 was set to 0.23 (relative dielectric constant ∈=2.3 and thickness d=10 [μm]), and the PDPs were connected to respective drive circuits, similarly to test 2. Upon driving the PDPs in the stable driving area and substituting measurements of the luminance meter and power meter in a known equation, the luminous efficiency of the PDP of comparative example 1 was 2.3 [lm/w], while the luminous efficiency of the PDP of working example 2 was 3.0 [lm/w], thereby confirming that luminous efficiency in the PDP of working example 2 was improved 30% over that of the PDP of comparative example 1.

Embodiment 2

Figure 2:
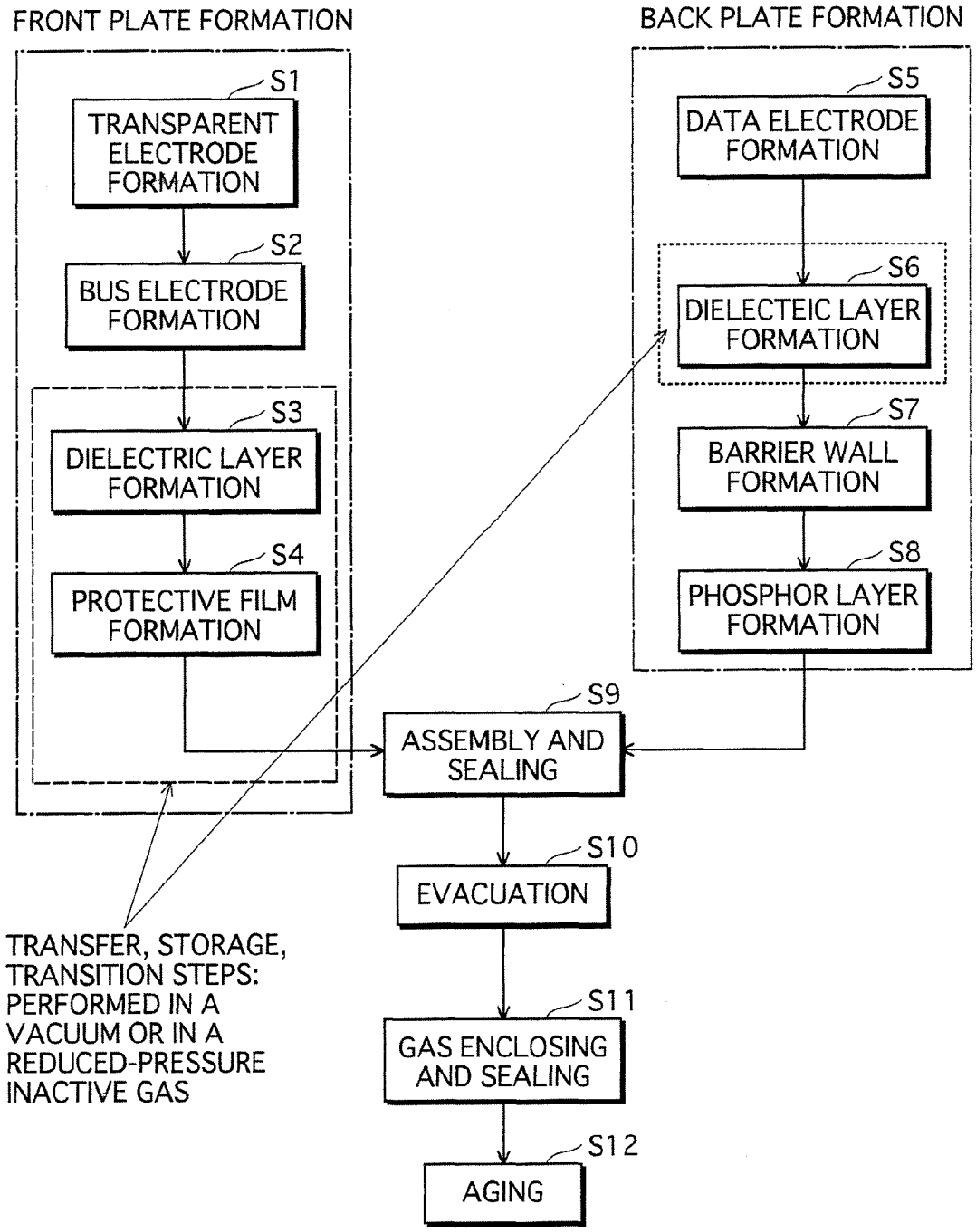
FIG. 2 is a conceptual flowchart showing steps in a manufacturing method for the PDP 1 pertaining to embodiment 2 of the present invention.
Figure 3:
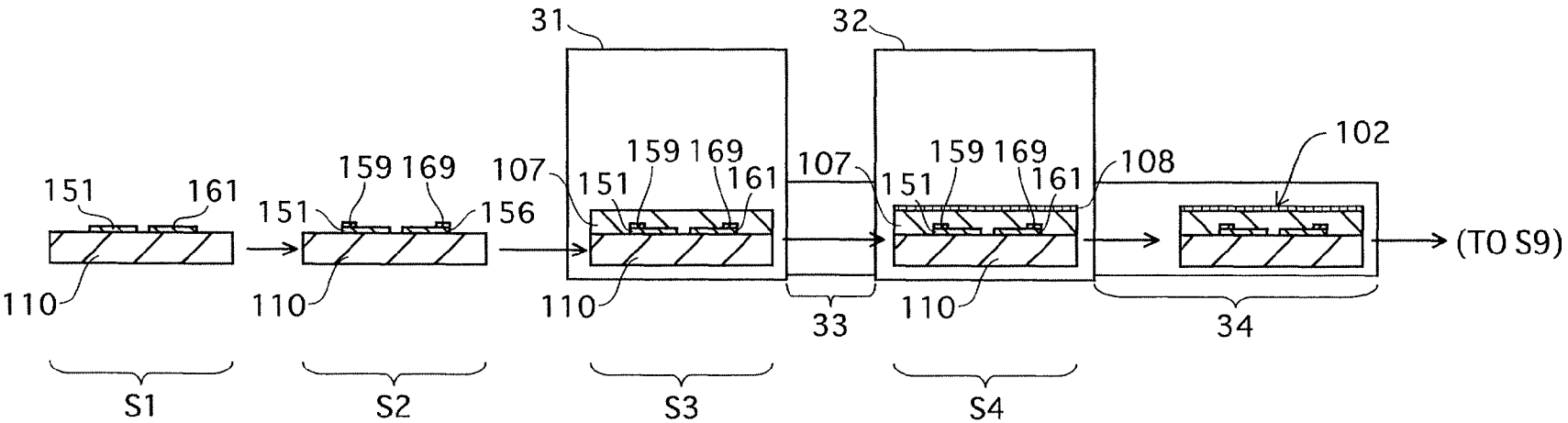
FIG. 3 is a conceptual cross-sectional diagram showing formation steps for a front plate 2 in the manufacturing method for the PDP 1 pertaining to embodiment 2 of the present invention.
Figure 4:
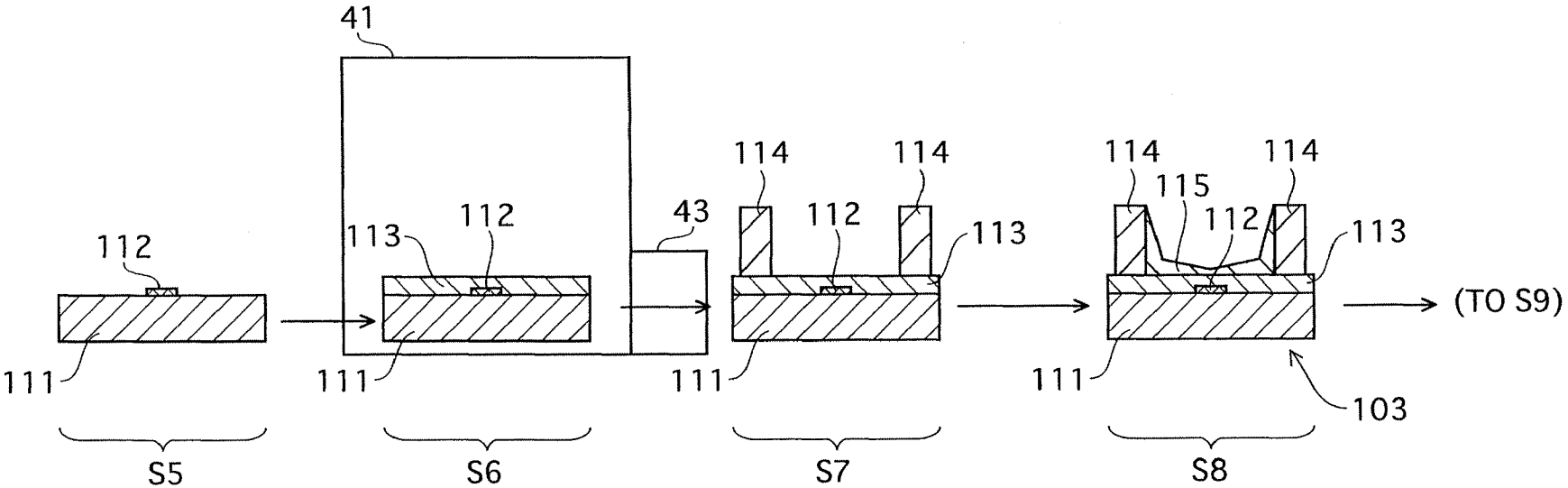
FIG. 4 is a conceptual cross-sectional diagram showing formation steps for a back plate 3 in the manufacturing method for the PDP 1 pertaining to embodiment 2 of the present invention.

The following describes a method for manufacturing the PDP 101 of embodiment 1 with references to FIG. 2 to FIG. 4.

FIG. 2 is a flowchart showing a manufacturing process for the PDP 101 pertaining to embodiment 2 of the present invention. FIG. 3 is a process chart showing an overview of a process for forming the front plate 102 of the PDP 101, and FIG. 4 is a process chart showing an overview of a process for forming the back plate 103 of the PDP 101. Note that the front plate 102 in FIG. 3 is shown inverted with respect to the front plate 102 in FIG. 1B. Also, in FIG. 3 the same reference numbers have been given to features the same as in FIGS. 1A and 1B, and a portion of the reference numbers have been omitted for the sake of simplification. Moreover, the disposition of the substrate in the device shown in FIG. 3 may be inverted.

Formation Process for the Front Plate 102

As shown in S1 of FIG. 3, the pair of transparent electrodes 151 and 161 is formed by laminating a transparent electrode film composed of ITO, $SnO_2$, ZnO, etc. with a film thickness of approximately 100 [mm] on the main surface of the glass substrate 110, and performing wide patterning by a photolithography method to form the electrodes parallel to each other and in opposition to each other so as to sandwich a discharge gap therebetween (S1 in FIG. 2).

Next, as shown in S2 of FIG. 3, an Al—Nd alloy thin film is formed on the main surface of the transparent electrodes 151 and 161 by a vacuum film formation process such as a vacuum deposition method, an electron beam deposition method, a plasma beam deposition method, or a spattering method in a vacuum or reduced-pressure spattering gas atmosphere with a substrate temperature of room temperature to 300 [° C.], using an Al series metallic electrode material that includes at least a rare earth metal such as Al—Nd (containing 2% to 6% of Nd by weight).

It is preferable for 2% to 6% of Nd to be contained in the Al—Nd alloy thin film. This is because when less than 2%, the effects obtained by adding Nd are insufficient, and when 2% or more, the formation of hillocks (minute protrusions unnecessary to the electrode structure) can be suppressed at even a substrate temperature of 300 [° C.], but when 6% or more, it is difficult to form a film with even quality, and the problem of thermal stress becomes significant.

Next, the Al—Nd alloy thin film is patterned more narrowly than the transparent electrodes 151 and 161 using a low temperature process at room temperature to 300 [° C.] such as a photo etching method or more preferably a dry etching method, thereby forming the bus electrodes 159 and 169 composed of the Al—Nd alloy thin film in substantially parallel alignment.

Here, using a dry etching process enables the bus electrodes 159 and 169 to be formed with almost no inclination or unevenness at the electrodes edges.

Also, an Al series metal composed of Al—Nd can be used in a low-temperature process at or below 300 [° C.] in a patterning process performed by dry etching.

In this way, the display electrode pair 104 is constituted by the pairing of the scan electrode 105 composed of the transparent electrode 151 and bus electrode 159 and the sustain electrode 106 composed of the transparent electrode 161 and bus electrode 169.

Unlike a metal body including Ag as the main component, a metal body including Al—Nd as main components is more homogenous and has superior electrical properties (low resistance), thereby enabling the formation of denser and thinner bus electrodes 159 and 169 than in conventional PDPs, while maintaining superior electrical properties.

As shown in S3 of FIG. 3, the substrate 110 including the bus electrodes 159 and 169 formed on the main surface of the transparent electrodes 151 and 161 is inserted into a CVD apparatus 31 able to perform a CVD method, a plasma CVD method, an ICP-CVD method etc., and the dense dielectric layer 107 including at least $SiO_2$ is formed on the substrate 110 by any of the above methods (S3 of FIG. 2).

The dielectric raw material and film formation conditions differ according to the CVD method, and a suitable film formation speed and density can be obtained by appropriately selecting the raw material and film formation conditions.

Here, the dielectric layer 107 is formed using, for example, a dielectric raw material including TEOS (tetra-ethyl-oxysilane) gas, and by a high-speed CVD method utilizing the ICP-CVD method (Inductively-Coupled Plasma CVD).

Note that although not depicted for the sake of simplicity, the CVD apparatus 31 shown in FIG. 3 is provided with an oxygen gas supply ring, and a vapor gas supply ring from a vaporization apparatus for vaporizing TEOS (tetra-ethyl-oxysilane) gas is provided in a vicinity of the substrate.

In an ICP-CVD method, the interior of the CVD apparatus 31 is quickly evacuated using a turbomolecular pump and a rotary pump which are not depicted, and after forming a vacuum, oxygen gas is supplied into the evacuated ICP-CVD reaction furnace 31 and maintained at a predetermined pressure, and upon supplying RF power to an antenna, radio waves are introduced into the ICP-CVD apparatus 31, thereby forming an inductive electric field.

Electrons that are heated by the inductive electric field collide with the gas molecules to generate ions and other electrons.

This results in the formation of a relatively homogenous plasma that includes a large amount of ions and electrons. The oxygen gas that is heated to a high temperature and activated in the plasma reaches the vicinity of the substrate due to dispersion.

Here, a film including $SiO_2$ as the main component is formed on the main surface of the substrate 110 by causing the activated oxygen gas and the TEOS vaporized gas to react.

The dielectric layer 107 composed of a dense and thin $SiO_2$ film can be formed at the high speed of approximately 2.5 [μm/min] by appropriately selecting conditions such as chamber pressure, oxygen gas flow rate, and the TEOS vaporized gas supply rate.

The temperature of the substrate is between room temperature and 300 [° C.] when forming the dielectric layer 107, whereby it is possible to form the dielectric layer 107 using a low-temperature process.

When formed using the aforementioned process, the density of the dielectric layer 107 is improved over that of conventional PDPs, thereby improving the withstand voltage of the dielectric layer 107. In other words, it is possible to form the dielectric layer 107, which contributes to the improvement in the luminous efficiency of the PDP, by a low temperature process more quickly and with stable quality. Also, the dielectric layer formation step (S3) which uses a low-temperature process enables the suppression of warpage and cracks in the panel that occur due to the conventional baking of dielectric layers and high-temperature processes.

As shown in FIG. 3, the substrate 110 on which the dielectric layer 107 has been formed is transferred from the CVD apparatus 31 to a vacuum deposition apparatus 32 via a passageway 33.

The passageway 33 is kept in advance in a vacuum or reduced-pressure state, or a reduced-pressure state substituted with the inactive gases $N_2$ and Ar.

In some cases, the substrate 110 is temporarily stored in the passageway 33 in the reduce-pressure state.

The substrate 110 is transferred via the passageway 33 in a vacuum or inactive gas atmosphere at a reduce pressure, and if being stored in the passageway 33, it is desirable to lower the partial pressure of impure gases in the atmosphere of the passageway 33 to below 100 [kPa], or more desirably to 0.13 [kPa] or lower.

Next, as shown in S4 of FIG. 3, the protective film 108 including the metal oxide MgO is formed to a predetermined film thickness on the dielectric layer 107 of the transferred substrate 110 (S4 of FIG. 2). The protective film 108 is formed in the vacuum deposition apparatus 32 in a vacuum or at a reduce-pressure atmosphere including a spattering gas such as Ar, by a vacuum deposition process using a low-temperature process such as an electron beam vapor deposition method, spattering method, etc.

Here, the vacuum deposition process refers to a process of forming a thin film in a vacuum, and includes methods such as an electron beam vapor deposition method, spattering method, as well as a vacuum vapor deposition method, plasma beam vapor deposition method, and various CVD methods. It is possible to form a protective film at a low temperature in a vacuum deposition process.

This enables the formation of a high quality protective film while maintaining stability, since the protective film 108 is formed at a reduced-pressure by a vacuum deposition process following the formation of the dielectric layer 107. Also, using a low-temperature process in the vacuum deposition process enables the suppression of warpage and cracks in the panel that occur due to conventional high-temperature processes.

As shown in S4 of FIG. 3, in order to suppress reaction with and the adsorption of impure gases (mainly $H_2O$ and $CO_2$) to the protective film 108, not only are at least the dielectric layer 107 and the protective film 108 formed on the main surface of the substrate 110 in a vacuum to form the front panel 102, but the reduced pressure state is maintained during the transfer step to the next step, the storage step, and the transition step to the panel sealing step, and the front panel 102 is transferred via the passageway 34 in a vacuum or reduced-pressure state substituted with the inactive gases $N_2$ and Ar, and stored in the passageway 34.

When transferring the front panel 102 via the passageway 34 in the vacuum or inactive gas atmosphere, or storing the front panel 102 in the passageway 34, it is desirable to lower the partial pressure of impure gases in the passageway 34 to below 100 [kPa], or more desirably to 0.13 [kPa] or lower.

In the manufacturing steps, the dielectric layer 107 and the protective film 108 are formed on the main surface of the substrate 110 without coming into contact with air at least from the film formation steps (S1 to S4) to the panel sealing step (S9), i.e., from steps S1 to S9 of FIG. 2, and, by storing and maintaining the substrate 110 on which the dielectric layer 107 and the protective film 108 were formed at the reduced pressure, impure gases do not adsorb to either the dielectric layer 107 or the protective film 108, nor do hydroxylation reactions or carbonation reactions occur due to impure gases. As a result the performance of the dielectric layer 107 and the protective film 108 formed in the vacuum is maintained until completion of the PDP.

Consequently, in the manufacturing steps for the front plate 102, it is possible to stably manufacture the front plate 102 having the bus electrodes 159 and 169, the dielectric layer 107 and the protective film 108 with reliability and quality that are improved over conventional technology, while maintaining a high secondary electron emission efficiency and reducing the discharge inception voltage, as well as improving sputter resistance properties.

2. Manufacturing Steps for the Back Plate 103

As shown in S5 of FIG. 4, an Al—Nd metal alloy thin film is formed using a metal electrode material including at least Al—Nd in a low temperature processing by, similarly to as mentioned above, a vacuum deposition process method or dry etching method, and the Al—Nd metal alloy thin film is patterned in a low-temperature process to form the data electrode 112 (S5 of FIG. 2).

Next, as shown in S6 of FIG. 4, the substrate 111 having the data electrode 112 formed thereon is inserted into a CVD apparatus 41 able to perform a CVD method, a plasma CVD method, an ICP-CVD method etc., and the dielectric layer 113 including at least $SiO_2$ is formed to a predetermined film thickness on the main surface of the substrate 111 so as to cover the data electrode 112 by, similarly to the manufacturing steps for the front plate 102 and the dielectric layer 107, using any of various types of low-temperature CVD methods such as a CVD method or an ICP-CVD method (S6 of FIG. 2).

As mentioned above, the dielectric layer 113 is formed in a low-temperature process, thereby enabling the suppression of warpage and cracks in the substrate 111 that occur when the dielectric layer is formed in a conventional baking step.

It is also desirable to maintain a reduced-pressure state from the step for forming the dielectric layer 113 until the step for forming the barrier ribs 114 and the phosphor layers 115.

As a result, the dielectric layer 113 is kept in a reduced-pressure state at all times during steps involving exposure, whereby impure gases are not absorbed thereby, which enables the manufacture of the back plate 103 with stable quality.

Also, as shown in S7 of FIG. 4, the barrier ribs 114 having a substantially uniform height are formed on the main surface of the dielectric layer 113 (S7 of FIG. 2).

It is desirable to use a non lead-based glass material as the barrier ribs 114, which are formed by applying and baking the non lead-based glass material into a rib configuration in a predetermined pattern so as to divide a plurality of discharge cells into stripes or a lattice formation.

Next, as shown in S8 of FIG. 4, the phosphor layers 115 are formed in the groove portions separated by the barrier ribs 114, using phosphors such as $(Y,Gd)BO_3$:Eu, $Zn_2SiO_4$:Mn and $BaMg_2Al_{14}O_{24}$:Eu (S8 of FIG. 2).

The phosphor layers 115 are printed per color to the groove portions, and after application and baking, are formed on the side surfaces of the barrier ribs 114 and on the main surface of the dielectric layer 113.

As a result, in the manufacturing steps for the back plate 103, the reduced pressure state is maintained during at least the step for forming the dielectric layer 113 (S6) and the intermediate step for transfer to the next step for forming the barrier ribs 114 (S7), whereby the dielectric layer 113 does not come into contact with air during at least these steps. The back plate 103 can therefore be stably manufactured with increased reliability since it is transferred to the step for forming the barrier ribs 114 (S7) without impure gases adsorbing to the dielectric layer 113.

Also, although a specific description has been omitted, in the panel sealing step (S9 of FIG. 2), the front plate 102 on which the bus electrodes 159 and 169, the dielectric layer 107 and the protective film 108 have been formed in at least a vacuum or at a reduced pressure, and the back plate 103 on which the data electrode 112 and the dielectric layer 113 have been formed in at least a vacuum or at a reduced pressure, and on which the barrier ribs 114 and the phosphor layers 115 have been formed, are disposed in opposition, and edges thereof are sealed together (S9 of FIG. 2).

Thereafter, the panel interior is evacuated to a high vacuum (S10 of FIG. 2), a mixed gas including the rare gases xenon and neon is enclosed and sealed at a predetermined pressure in the panel as the discharge gas (S11 of FIG. 2), and an aging step (S12 of FIG. 2) is performed, thereby forming the PDP 101.

Effects of the PDP of Embodiment 2

In the manufacturing method for the PDP of the present embodiment, since the bus electrodes 159 and 169 are formed in a vacuum deposition process, compared to conventionally forming bus electrodes with a thick film method, binder baking materials do not remain in the bus electrodes, thereby eliminating the formation of gas bubbles in the subsequent step for forming the dielectric layer 107. This enables the formation of the dielectric layer 107 in which dielectric breakdown does not readily occur. It is therefore possible to form a thinner dielectric layer 107 than in conventional manufacturing methods for PDPs.

Also, in the manufacturing method for the PDP of the present embodiment, the dielectric layer 107 is formed using the ICP-CVD method, thereby enabling the formation of a denser dielectric layer 107 than when conventionally using a pressure film method, which makes it possible to give the dielectric layer 107 a high withstand voltage, and as a result, form a thin dielectric layer 107. Using the ICP-CVD method in particular enables faster formation than when using a conventional thick film method or other CVD method.

Consequently, in the manufacturing method for the PDP of the present invention, it is possible to manufacture a PDP with a reduced discharge sustain voltage and discharge inception voltage, and with improved luminous efficiency, more quickly than with conventional manufacturing methods for PDPs.

In the manufacturing method for the PDP of the present embodiment, the step for laminating the dielectric layer 107 is simpler than the manufacturing method for the PDP of patent document 1, thereby enabling the manufacture of a high quality and highly reliable PDP.

In the manufacturing method for the PDP of the present invention, a vacuum or reduced-pressure state is maintained from the step for forming the dielectric layer 107 until the steps for transferring and storing the front plate 102 having the dielectric layer 107 formed thereon, and transitions to the next steps, thereby, compared to the manufacturing method for the PDP of patent document 2, suppressing the dielectric layer 107 from contacting the air and the adsorption of impure gases to the dielectric layer.

In the manufacturing method for the PDP of the present invention, a vacuum or reduced-pressure state is maintained from the step for forming the protective film 108 until the steps for transferring and storing the front plate 102 having the protective film 108 formed thereon, and transitions to the next steps, thereby, compared to the manufacturing method for the PDP of patent documents 1 and 2, suppressing the protective film 108 from contacting the air and the adsorption of impure gases to the protective film.

Consequently, compared with the manufacturing method for the PDP of patent documents 1 and 2, a PDP with more stable quality, higher reliability, and longer lifetime can be manufactured in the manufacturing method for the PDP of the present embodiment.

Note that although TEOS gas is used as the dielectric layer raw material in the above description, another organic silane-based material may be used.

Also, although formed using MgO in the above description, the protective film 8 may be formed using a metal oxide such as BaO, CaO, SrO, MgNO or ZnO.

Also, although formed by a CVD method in the above description, the dielectric layer 113 of the back plate 103 may be formed by printing and baking a low melting glass dielectric layer, the same as in conventional back plates.

Also, although the data electrode 112 of the back plate 103 is formed in a vacuum using a metal material including Al—Nd, an Ag electrode may be formed by printing and baking, or a Cr—Cu—Cr electrode may be formed in a vacuum, the same as in conventional back plates.

Also, although at least the bus electrode 109, the dielectric layer 107, and the protective layer 108 are formed on the front plate 102, and at least the data electrode 112 and the dielectric layer 113 are formed on the back plate 103 in the above description, the invention of the present embodiment is similarly applicable even if the disposition of the layers and films is reversed as in reflective PDPs, and the layers and films may be formed on either of the opposing substrates.

Embodiment 3

In the present embodiment, there is shown a variation of the configuration of the bus electrodes provided in intervals between the display electrodes of a pair of electrodes on a surface parallel to the main surface of the substrate.

Figure 5A:
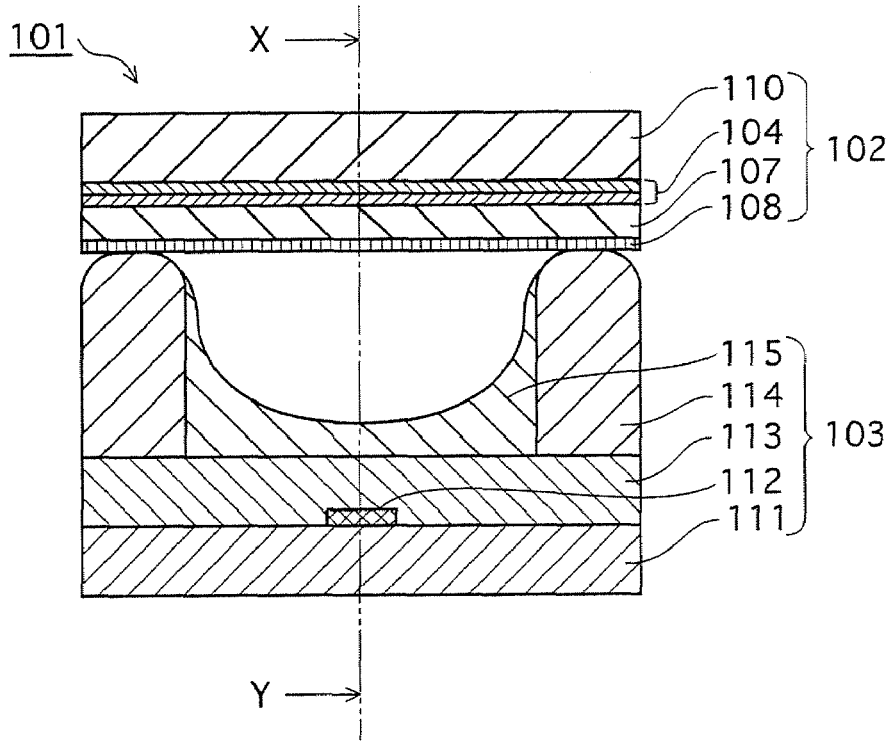
FIG. 5A is a relevant cross-sectional view of a structure of a PDP in embodiment 3.
Figure 5B:
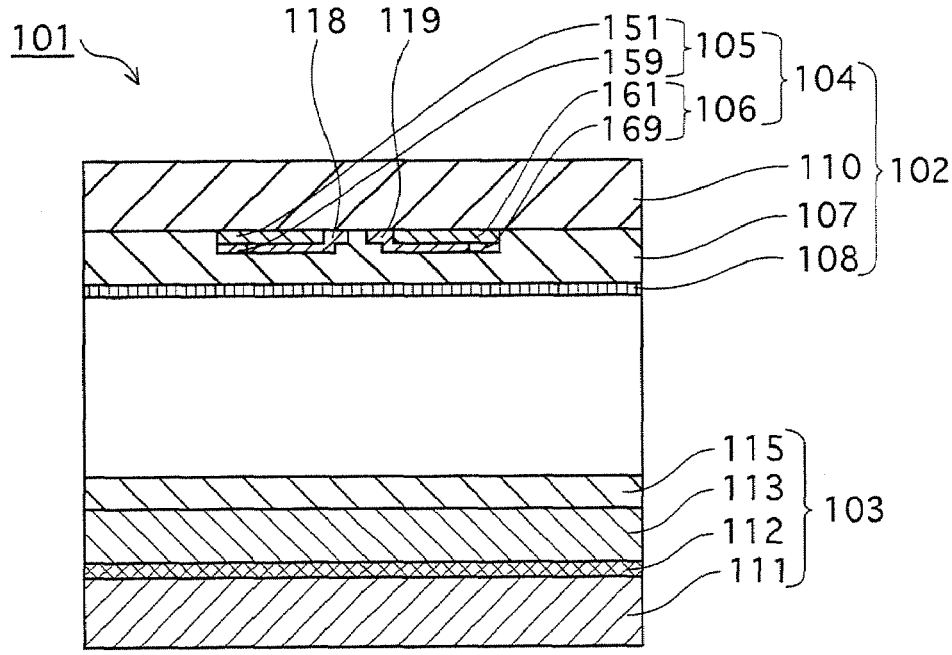
FIG. 5B is a relevant cross-sectional view taken along plane X-Y in FIG. 5A.

FIG. 5A is a relevant cross-sectional view corresponding to a cross-section cut along the display electrodes, and FIG. 5B is a relative cross-sectional view corresponding to a cross-sectional taken along plane X-Y of FIG. 5A.

In the present embodiment, only the structure of the bus electrodes differs from embodiment 1, and descriptions of structures other than the bus electrodes have therefore been omitted.

As shown in FIG. 5B, the scan electrode 105 and the sustain electrode 106 each include protrusions 118 and 119 and bases constituted from the transparent electrodes 151 and 161 and the bus electrodes 159 and 169 respectively. The base of the scan electrode 105 and the base of the sustain electrode 106 are disposed in opposition so as to sandwich a first gap therebetween, the protrusions 118 of the scan electrode 105 and the protrusions 119 of the sustain electrode 106 sandwich a second gap therebetween that is narrower than the first gap, and a plurality of the protrusions are arranged on opposing edges of the substrates in each discharge cell.

Variation 1

The following describes a structure of the display electrodes of PDP discharge cells in variation 1.

Figure 6A:
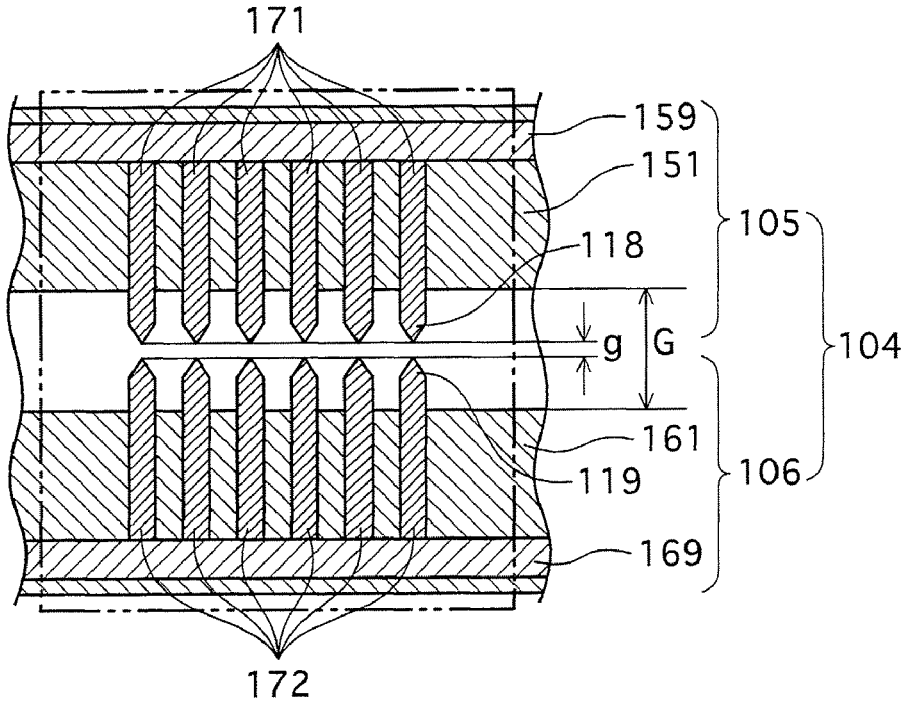
FIG. 6A is a relevant planar diagram showing part of a discharge cell of a PDP in variation 1 of embodiment 3.
Figure 6B:
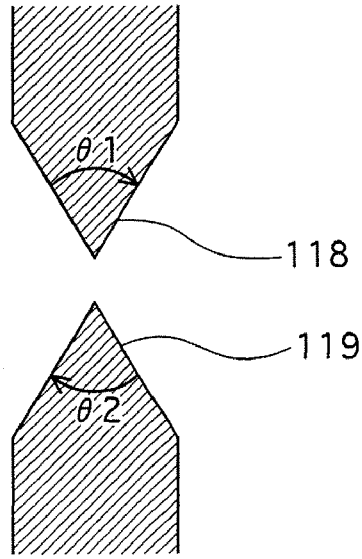
FIG. 6B is an enlarged relevant planar diagram showing the part indicated in FIG. 6A.

FIG. 6A shows a portion of a display electrode pair from the back plate side, and the region encompassed in the dashed double-dotted line corresponds to the discharge cell. FIG. 6B is an enlarged relevant planar diagram showing the part indicated in FIG. 6A.

As shown in FIG. 6A, electrode machined parts 171 and 172 extend from one of the bus electrodes 159 and 169 that constitute the display electrode pair 104 toward the other of the bus electrodes 159 and 169, and protrude out of the opposing edges of the transparent electrodes 151 and 161, and as a result, when the transparent electrodes 151 and 161 and the bus electrodes 159 and 169 are considered to be the bases, the parts protruding out from the bases correspond to the protrusions 118 and 119. A gap g between opposing protrusions 118 and 119 is narrower than a gap G between the transparent electrodes 151 and 161, and is kept uniform. For example, when the gap G is 50 [μm] to 100 [μm], it is desirable for the gap g to be 1 [μm] to 10 [μm]. This enables the electrical resistance from the bus electrodes 159 and 169 to the tips of the protrusions 118 and 119 to be reduced, enables the protrusions 118 and 119 to be formed at the same time as the bus electrodes 159 and 169 using a microfabrication process used in the formation thereof, and enables the electrical field intensity between the protrusions 118 and 119 to be strengthened.

As shown in FIG. 6B, tip angles θ1 and θ2 of the protrusions 118 and 119 are in the range of 10 degrees or more to less than 90 degrees, and the tip edges are formed such that a surface parallel to the main surface of the scan electrode 105 has an acutely-angled contour. The tip angles θ1 and θ2 may be the same or different angles. Note that the tip edge configuration of the protrusions 118 and 119 is not limited to being an acute angle, but rather may be formed with a curved contour.

Steps for forming the protrusions 118 and 119 so as to sandwich a narrow gap therebetween from 1 [μm] to 10 [μm], and for forming the tips of the protrusions 118 and 119 into acute angles can be realized by a process similar to fine process machining used when forming the bus electrodes 159 and 169, which are thin film metal electrodes.

Note that in variation 1, a total of four protrusions 118 and 119, that is, a pair of opposing protrusions and a pair of neighboring protrusions, may be considered a group, the tips of all the protrusions 118 and 119 in a group may be formed to have the same interval, and furthermore, the protrusions 118 and 119 may be disposed such that an imaginary line directly connecting the tips of the protrusions 118 and 119 would form a square.

Variation 2

Figure 7A:
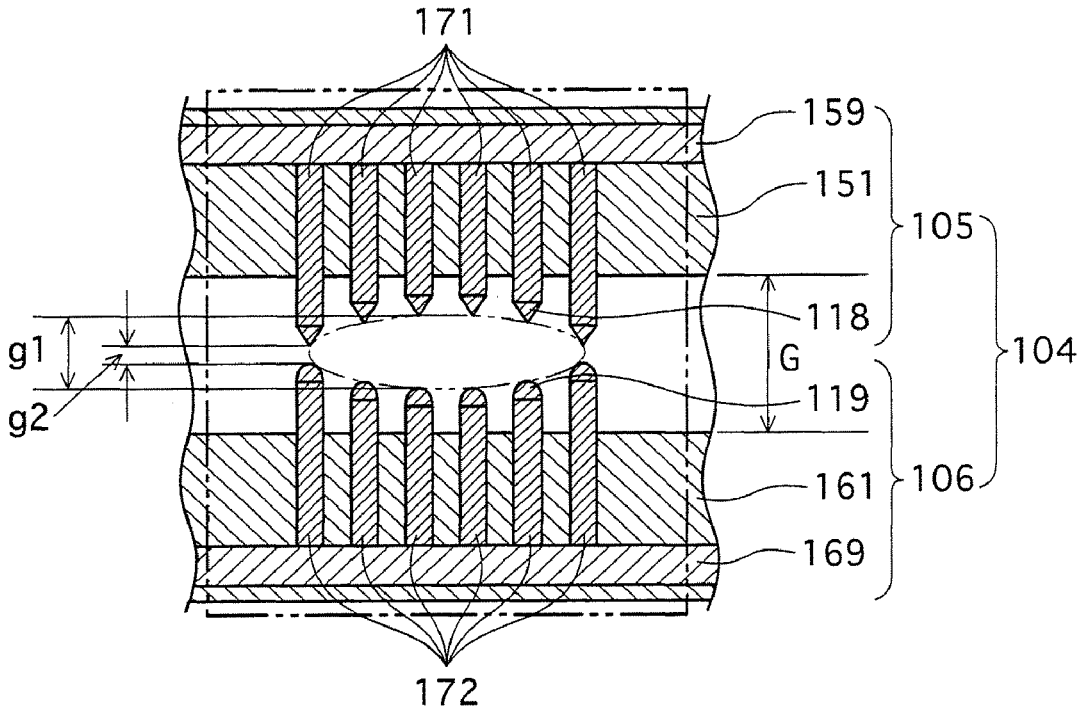
FIG. 7A is a relevant planar diagram showing part of a discharge cell of a PDP in variation 2 of embodiment 3.
Figure 7B:
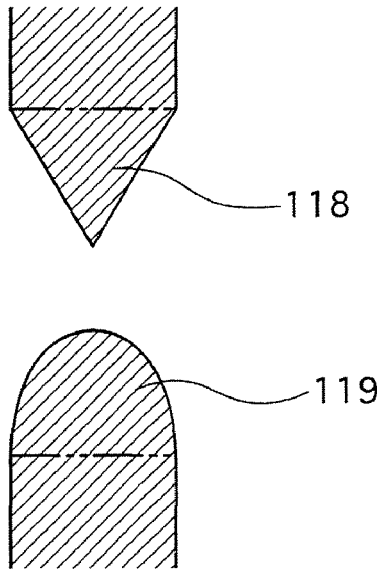
FIG. 7B is an enlarged relevant planar diagram showing the part indicated in FIG. 7A.

FIG. 7A shows a portion of a display electrode pair from the back plate side, and the region encompassed in the dashed double-dotted line corresponds to the discharge cell. FIG. 7B is an enlarged relevant planar diagram showing the part indicated in FIG. 7A.

FIGS. 7A and 7B differ from FIGS. 6A and 6B in that the gap sandwiched by the protrusions 118 of the scan electrode 105 and the protrusions 119 of the sustain electrode 106 varies in the discharge cell in the direction in which the scan electrode 105 and the sustain electrode 106 extend, and in that the shape of the tip edges of the protrusions 118 and 119 differ between protrusions 118 and 119 that are in an opposing relationship between different electrodes. A description of the structures previously described using FIGS. 6A and 6B has therefore been omitted.

In variation 2, as shown in FIG. 7A, the protrusions 118 and the protrusions 119 are disposed in opposition to each other such that the gap sandwiched by the protrusions 118 and 119 of the scan electrode 105 and the sustain electrode 106 is wide at gap g1, and becomes narrower along the direction in which the scan electrode 105 and the sustain electrode 106 extend in accordance with increasing distance from the center portion, giving a narrow gap g2 at the border portion (on the barrier wall sides) of the discharge cell.

For example, when the gap g2 is in the range of 1 [μm] to 5 [μm], it is preferable for the gap g1 to be in the range of 5 [μm] to 10 [μm], although the gaps g1 and g2 are not limited to such ranges. The variations of these values can be appropriately set to vary gradually or in steps. Note that although a pair of protrusions sandwiching the narrowest gap in the discharge cells is provided at each of the discharge cell border portions, the present variation is not limited to this. Two or more pairs of protrusions with the narrowest gap may be provided at each of the border portions.

Also, in the present embodiment, as shown in FIG. 7B, the tip edges of the protrusions 118 on the scan electrode 105 side, at the surface parallel to the direction in which the band-shaped scan electrode 105 and sustain electrode 106 extend, have been given a triangular shape, and the tip edge of the protrusions 119 on the sustain electrode 106 side have been given a semispherical shape. The present embodiment, however, is not limited to this. The shapes of the tips may be selected from a polygonal shape or a curved shape.

Furthermore, although the gap between opposing protrusions 118 and 119 is wider at the center portion of the discharge cell and becomes narrower according to increasing distance from the center portion, alternatively, the same effects may be achieved if pairs of protrusions sandwiching therebetween the narrowest gap may be provided at least two locations in the center portion of the discharge cell, and the gap widens according to increasing distance from the center portion of the discharge cell.

Variation 3

Figure 8A:
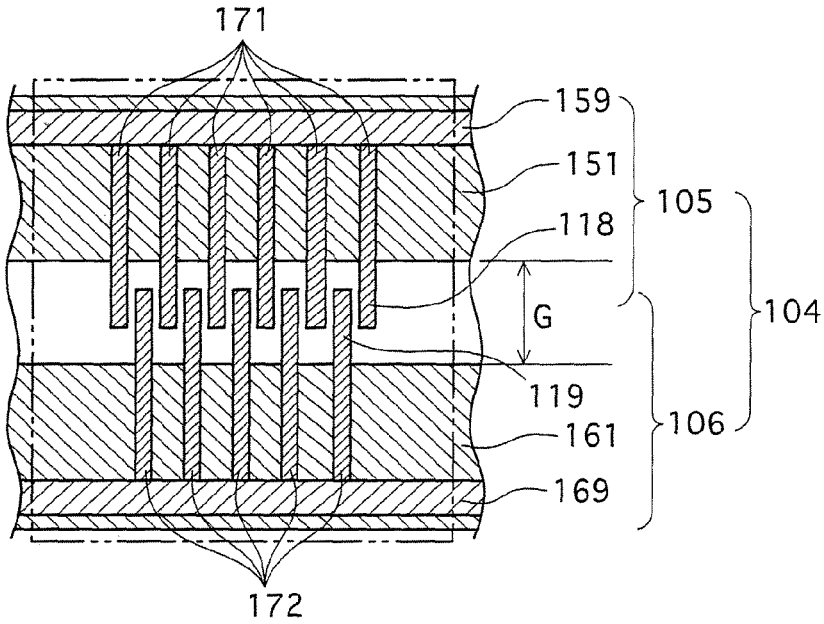
FIG. 8A is a relevant planar diagram showing part of a discharge cell of a PDP in variation 3 of embodiment 3.

FIG. 8A shows a relevant cross-sectional view of a portion of a discharge cell of the PDP of variation 3, showing a portion of the display electrode of the PDP from the back plate, where the area enclosed by the dashed double-dotted line corresponds to the discharge cell.

FIG. 8A differs from FIG. 6A and FIG. 7A in that the protrusions of the first and second electrodes are in a comb-teeth configuration and interposed with each other with a uniform gap therebetween, and descriptions of structures that have previously been described using FIG. 6A and FIG. 7A have therefore been omitted.

In variation 3, as shown in FIG. 8A, the protrusions 118 on the scan electrodes 105 side and the protrusions 119 on the sustain electrode 106 side are disposed at the opposing edges of the transparent electrodes 151 and 161 so as to be in comb-teeth configurations and to be interposed with each other.

Figure 8B:
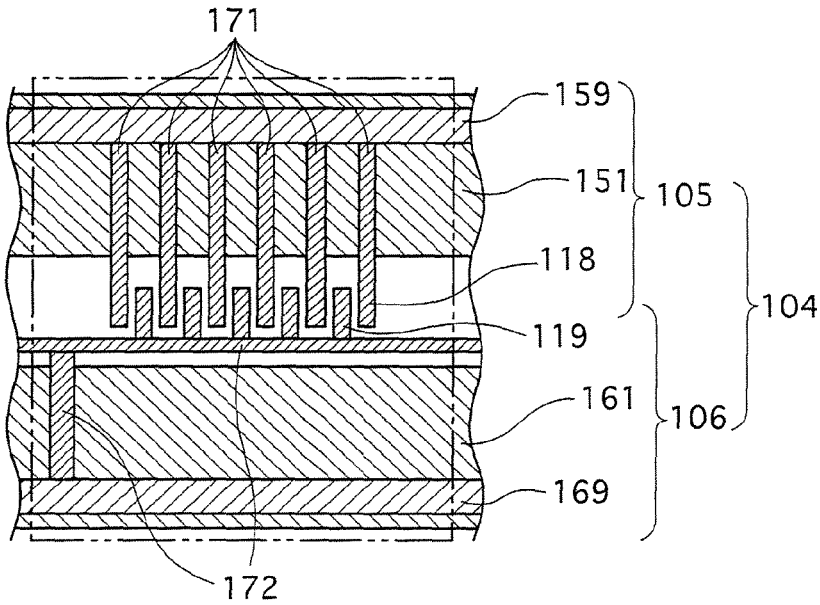
FIG. 8B is a relevant planar diagram showing a different embodiment of variation 3.

In variation 3, as shown in FIG. 8B, the protrusions 118 and 119 arranged in a comb-teeth configuration may be formed so as to, in at least one of the scan electrode 105 and the sustain electrode 106, extend from at least one of the bus electrodes 159 and 169, run parallel to the at least one bus electrode, and protrude out from the narrow electrode machined part 172. Similarly to FIG. 8A, FIG. 8B shows a portion of the display electrode pair of the PDP from the back plate side, and the area enclosed in the dashed double-dotted line corresponds to the discharge cell.

Note that in both the scan electrode 105 and the sustain electrode 106, the protrusions 118 and 119 arranged in a comb-teeth configuration may extend out from the narrow electrode machined parts so as to run parallel to both the bus electrodes 159 and 169.

Figure 8C:
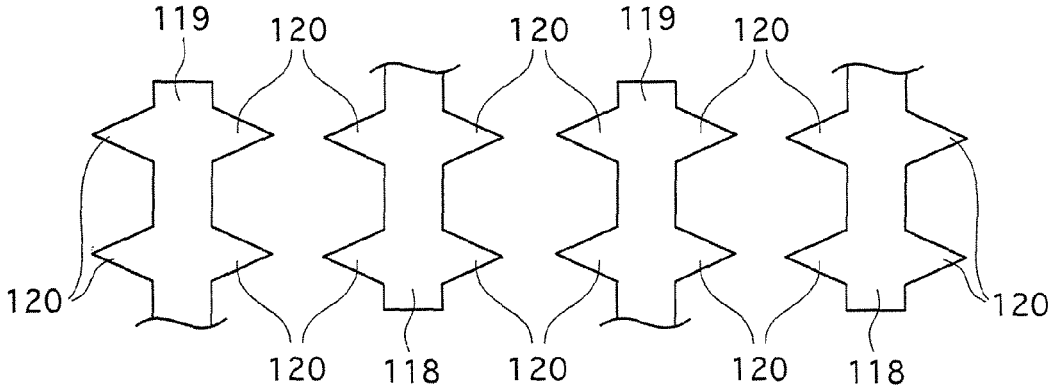
FIG. 8C is an enlarged planar view of a portion of the projection shown in FIG. 8A and FIG. 8B

Note that as shown in FIG. 8C, the edges of the protrusions 118 and 119 that face each other may be provided with projections 120. FIG. 8C is an enlarged relevant planar view of a portion of the projections 118 and 119 shown in FIGS. 8A and 8B.

Effects of the PDP of Embodiment 3

As described above, the protrusions 118 and 119 are provided on the opposing edges of the scan electrode 105 and the sustain electrode 106, and when power is supplied to these electrodes, an electrical potential concentrates at the protrusions 118 and 119, the electric field intensity between the protrusions 118 and 119 strengthens, and two or more sites where discharge readily occurs are formed in each discharge cell, thereby making it easier to cause discharges than when only one pair of protrusions are in each discharge cell. As a result, a sustain discharge can be reliably generated even if the discharge inception voltage is lowered. Also, if there is only one pair of protrusions in each discharge cell, when the protrusions 118 and 119 are misaligned in the extending direction of the display electrode pair 104 due to patterning precision, there may be variations in the discharge delay time of each of the discharge cells, whereas if two or more pairs of protrusions are provided in each discharge cell, the discharge delay times will not be readily influenced by patterning precision. Consequently, given that amount of variation in discharge delay times can be reduced, a sustain discharge can be reliably generated even if the discharge inception voltage is lowered, and the power consumption of the PDP can be lowered. Also, controlling the discharge delay times enables the realization of a high-definition PDP.

In variation 1, the gap between protrusions 118 and 119 in an opposing relationship is uniform, and by giving adjacent protrusions of the same electrode the same protrusion length from either the scan electrode 105 or the sustain electrode 106, discharges can be readily generated at for example, as shown in FIG. 2A, all six sites where the protrusions are in opposition, and two or more sites where discharges readily occur can be ensured even if there are misalignments of the protrusions 118 and 119 as mentioned above. Also, forming the tip edges of the protrusions 118 and 119 at the surfaces parallel to the main surface of the band-shaped scan electrode 105 to be acutely angled results in the electric potential concentrating in the protrusions 118 and 119, and even further concentrating at the acutely angled tips, thereby strengthening the electric field intensity in the gap sandwiched by the pairs of protrusions 118 and 119. This enables the discharge to be even more readily generated.

In variation 2, the gap sandwiched by the protrusions 118 of the scan electrode 105 and the protrusions 119 of the sustain electrode 106 is narrowest at the border parts of each discharge cell, whereby, for example, there are at least two sites where discharges readily occur as shown in FIG. 7A, and similarly to variation 1, the tip edges of the protrusions 118 and 119 at the surfaces parallel to the main surface of the band-shaped scan electrode 105 are acutely angled or curved, making discharges even more readily generated. In variation 2 in particular, the gap between the protrusions 118 and 119 in the center portion of each discharge cell is wider than in variation 1, thereby realizing the above-described effects while improving the aperture ratio.

In variation 3, due to the protrusions 118 and 119 being arranged in interposed comb teeth configurations, there can be provided a plurality of sites where discharges readily occur between each of the protrusions 119 and two of the protrusions 118 extending from the other electrode and in close proximity to the protrusions 119. This makes it possible to increase the number of sites where discharges readily occur over the number of sites when the protrusions are disposed in opposition between different electrodes, and enhances the above-described effects.

In particular, in variation 3, as shown in FIG. 8C, when two or more projections 120 are arranged on opposing edges of the protrusions 118 an 119 in opposition, the electric potential is concentrated at the projections 120, and the electric field intensity between opposing projections 120 is strengthened, thereby enhancing the above-described effects. Note that the projections 120 may be provided on only one out of the opposing protrusions 118 and 119. As shown in FIG. 8C, the projections 120 are triangular at a surface parallel to the main surface of the band-shaped scan electrode 105, although the projections are not limited to this. The projects may have a polygonal or curved contour.

Furthermore, in variations 1 to 3, the protrusions 118 and 119 can be formed at the same time as the microfabrication process used in the formation of the bus electrodes 159 and 169 since the protrusions 118 and 119 extend from the bus electrodes 159 and 169 and are formed from the same material as the bus electrodes. Also, the electrical resistance from the bus electrodes 159 and 169 to the protrusions 118 and 119 is lowered, thereby making it easier to manufacture the protrusions 118 and 119, and furthermore enabling a reduction in the dimensions of the discharge cells while improving response.

Evaluation Test

PDPs were manufactured based on variations 1 and 3, drive circuits etc. were connected thereto, and whether or not driving was stable was evaluated while varying the discharge inception voltage applied between the scan electrodes 105 and the sustain electrodes 106. The results confirmed that driving could be stably performed in both PDPs even at approximately 120 [V], which is lower than the conventional discharge inception voltage.

Embodiment 4

Figure 9A:
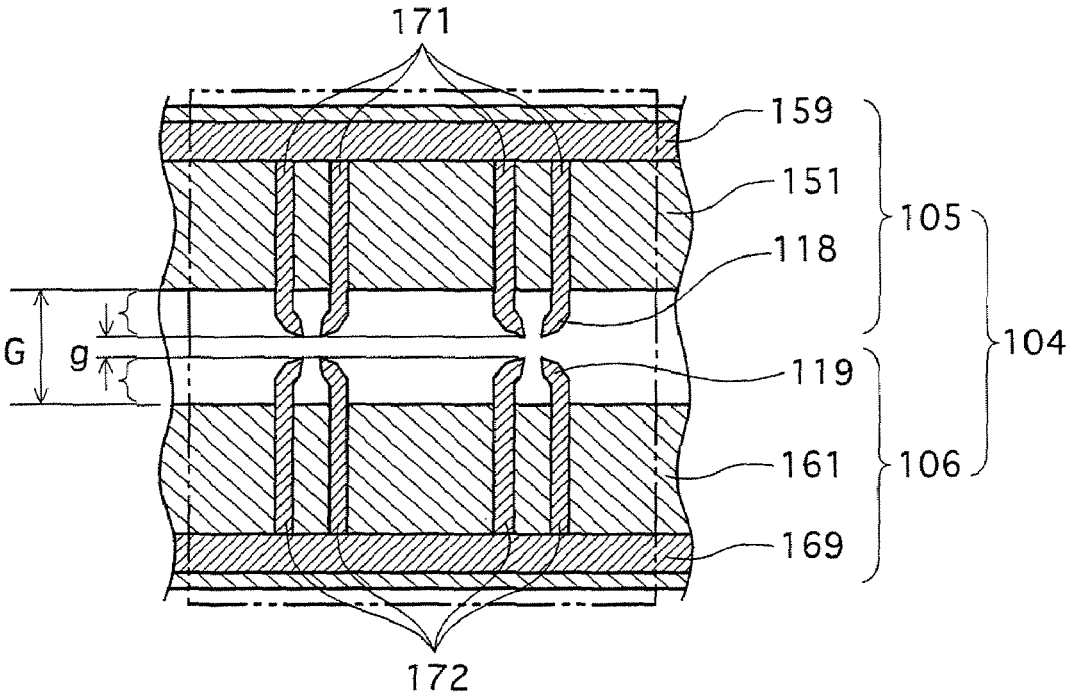
FIG. 9A is a relevant planar diagram showing part of a discharge cell of a PDP in embodiment 4.
Figure 9B:
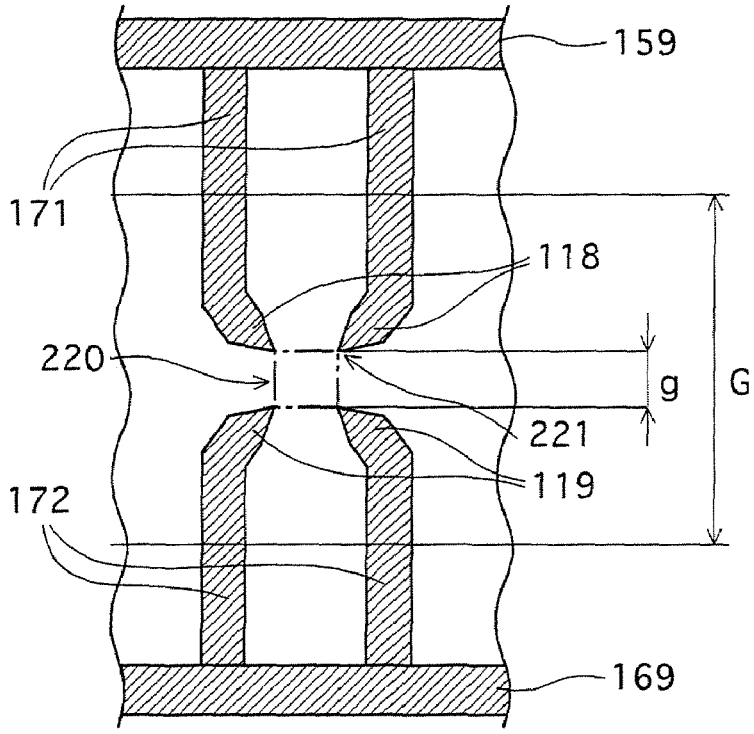
FIG. 9B is an enlarged relevant planar diagram showing the part indicated in FIG. 9A.

FIG. 9A shows a portion of a display electrode pair of a PDP from a back plate side, where the area enclosed in the dashed double-dotted line corresponds to a discharge cell. FIG. 9B is an enlarged relevant planar diagram showing the part indicated in FIG. 9A.

As shown in FIG. 9A, a display electrode pair 104 constituted from a scan electrode 105 and a sustain electrode 106 is arranged extending across two or more discharge cells, protrusions 118 and 119 are disposed in opposition so as to protrude out of opposing edges of transparent electrodes 151 and 161 that constitute the scan electrode 105 and sustain electrode 106 respectively, and opposing ones of the protrusions 118 and 119 are arranged so as to sandwich therebetween a gap g that is narrower than a gap G sandwiched by the transparent electrodes 151 and 161.

Electrode machined parts 171 and 172 that extend from one of the bus electrodes 159 and 169 toward the other of the bus electrodes 159 and 169 are caused to protrude out of the opposing edges of the transparent electrodes 151 and 161, whereby when the transparent electrodes 151 and 161 and the bus electrodes 159 and 169 are considered to be bases, the portions protruding out from the bases are considered to be the protrusions 118 and 119. Note that the electrode machined parts 171 and 172 are formed with a width of, for example, approximately 5 [μm].

The protrusions 118 and 119 form pairs on each of the electrodes and have acutely angled tip edges at surfaces parallel to the main surface of the band-shaped scan electrode 105, and the tips of the protrusions 118 and 119 that form each pair are formed so as to be curved toward each other in a claw configuration. Although the tip edges of the protrusions 118 and 119 are acutely angled in the above descriptions, the protrusions 118 and 119 are not limited to this, but rather may have a polygonal or curved contour. Although the electrode machined parts 171 and 172 have widths of approximately 5 [μm], the widths may be greater or smaller than this value.

In particular, as shown in FIG. 9B, the protrusions 118 and 119 are formed such that an imaginary line connecting tips 221 of opposing pairs of the protrusions 118 and 119 would form a square 220, and the tips 221 would be located at the corners of the square 220. The four tips 221 would oppose each other with an equal gap of, for example, approximately 5 [μm] therebetween.

Effects of the PDP of Embodiment 4

Similarly to embodiment 1, in the present embodiment, two or more of the protrusions 118 and 119 are provided in each discharge cell, and tip edges of the protrusions at surfaces parallel to the main surface of the scan electrode 105 are formed to be acutely angled, whereby electric potential is concentrated at the protrusions 118 and 119, and further concentrated at the tips of the protrusions. This enables the provision of two or more sites where discharges readily occur in each discharge cell, and makes it easier for discharges to readily occur than when only one pair of protrusions are provided in each discharge cell. Furthermore, in the present embodiment, since the length of the protrusion from the opposing edge of the scan electrode 105 or the sustain 106 is made the same measurement, adjacent protrusions of the same electrode form pairs, and the tips of the protrusions 118 and 119 that constitute the pairs are curved toward each other, when power is supplied to the scan electrode 105 and the sustain electrode 106, an equipotential line is connected between the tips at which the electric potential is concentrated and juts out toward the other electrode. Since the equipential line juts out toward the other electrode, when power is supplied to the scan electrode 105 and sustain electrode 106, a discharge occurs in a smaller discharge gap between opposing pairs of the protrusions 118 and 119 of the differing electrodes than the discharge gap between the opposing tips of the protrusions 118 and 119 of embodiment 3. The enables the reliable generation of a discharge even if a low voltage is applied, and enables a reduction in the amount of variation in the discharge delay time that occurs in the discharge cells. The power consumption of the PDP can therefore be reduced while maintaining the picture quality of the PDP.

In particular, the electric field is further concentrated between the pairs of protrusions 118 and 119 due to being disposed such that the imaginary line connecting the tips of the four closest protrusions 118 and 119 would form the square 220, thereby enhancing the above-described effects.

Furthermore, due to being formed so as to extend out from the bus electrodes 159 and 169, the protrusions 118 and 119 can be formed at the same time as the microfabrication process used in the formation of the bus electrodes 159 and 169. Also, given that the electrical resistance from the bus electrodes 159 and 169 to the protrusions 118 and 119 can be reduced, the protrusions 118 and 119 can be easily manufactured, and furthermore, response can be improved while reducing the dimensions of the discharge cells.

Although formed so as to extend out from the bus electrodes 159 and 169 in the present embodiment, as described above, the protrusions 118 and 119 may instead extend out of the opposing edges of the transparent electrodes 151 and 161 disposed in opposition.

Also, although the protrusions 118 and 119 are arranged in the present embodiment such that a square shape is formed by connecting the tips of four of the protrusions 118 and 119 that are curved into claw shapes, the protrusions 118 and 119 may instead be arranged such that the shape is a rectangle, parallelogram, trapezoid, or other polygonal shape.

Also, although the tips of the protrusions 118 and 119 that form pairs are described above as being formed so as to be curved toward each other into claw shapes, the present invention should not be limited to this. The tips of the protrusions 118 and 119 may have unsymmetrical shapes with respect to the center of the protrusions 118 and 119, and the tips of the protrusions 118 and 119 that constitute pairs may be shaped so as to face each other.

Note that although two pairs of protrusions are provided in the same electrode per discharge cell in the present embodiment as shown in FIG. 9A, only one pair of protrusions may be provided in the same electrode per discharge cell. Of course, two or more pairs of protrusions may be provided in the same electrode per discharge cell.

Although the protrusions 118 and 119 form pairs in both the scan electrode 105 and the sustain electrode 106 in the present embodiment, the protrusions 118 and 119 may form pairs in only one of the electrodes.

Evaluation Test

A PDP was manufactured based on the above embodiment, a drive circuit etc. was connected thereto, and whether or not driving was stable was evaluated while varying the discharge inception voltage applied between the scan electrodes 105 and the sustain electrodes 106. The results confirmed that driving could be stably performed in the PDP even at approximately 100 [V], which is lower than the conventional discharge inception voltage.

Embodiment 5

Figure 10:
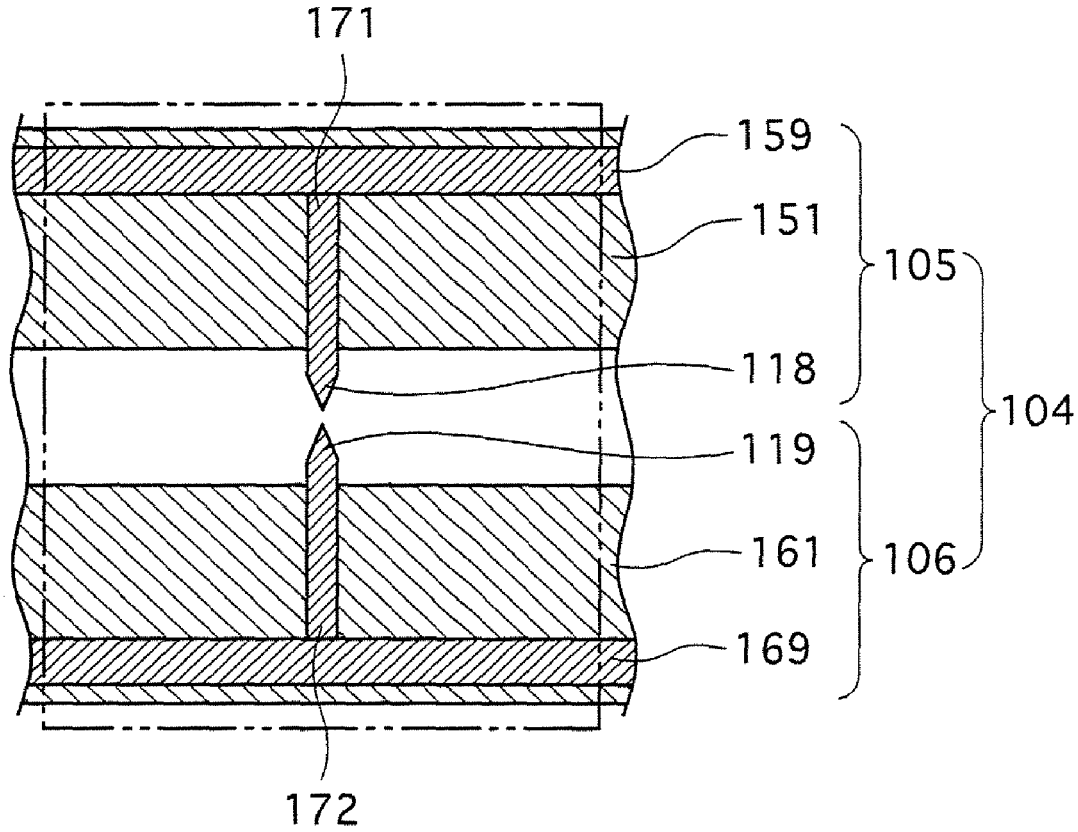
FIG. 10 is a relevant planar diagram showing part of a discharge cell of a PDP in embodiment 5.
Figure 11A:
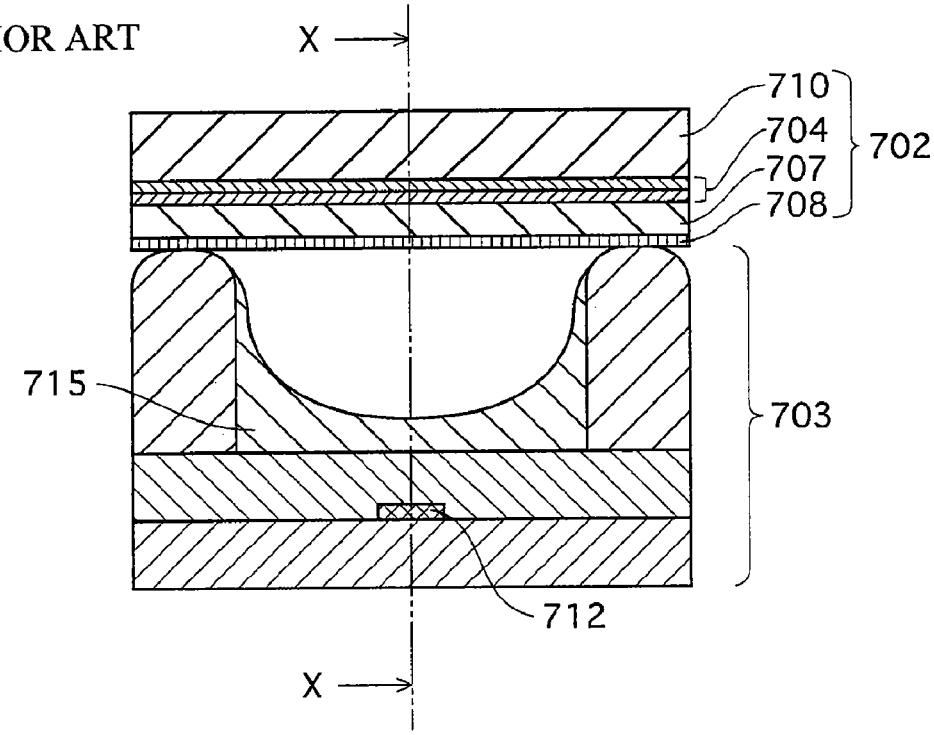
FIG.11A PRIOR ART
FIG. 11A is a relevant cross-sectional diagram showing a cross-section of a conventional surface discharge PDP cut along a display electrode.
Figure 11B:
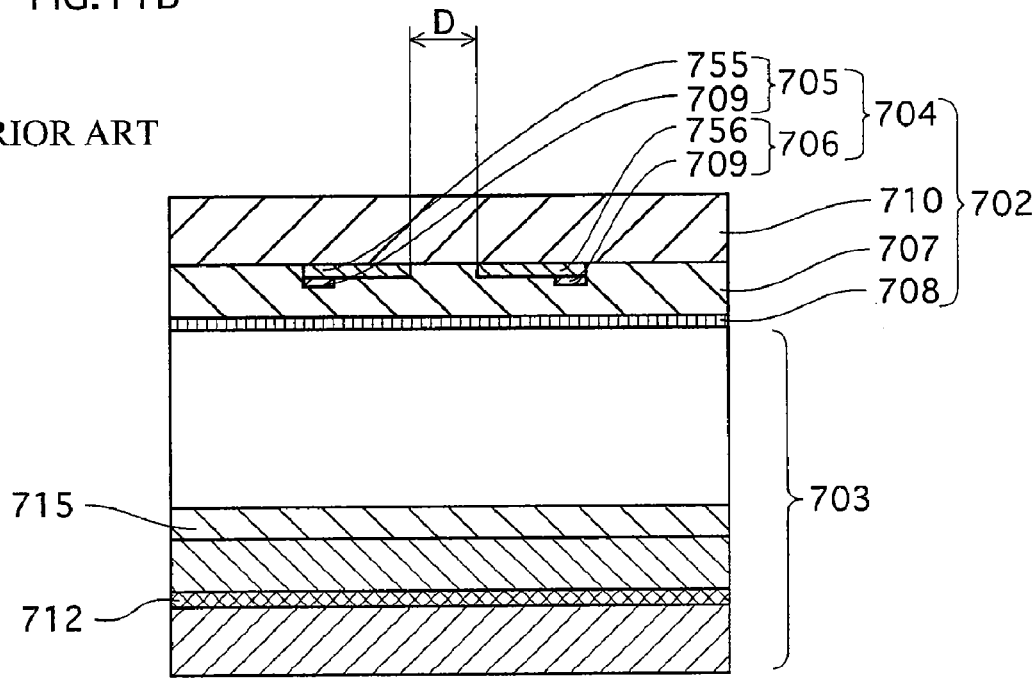
FIG.11B PRIOR ART
FIG. 11B is a relevant cross-sectional view of FIG. 11A taken along plane X-X.
Figure 12:
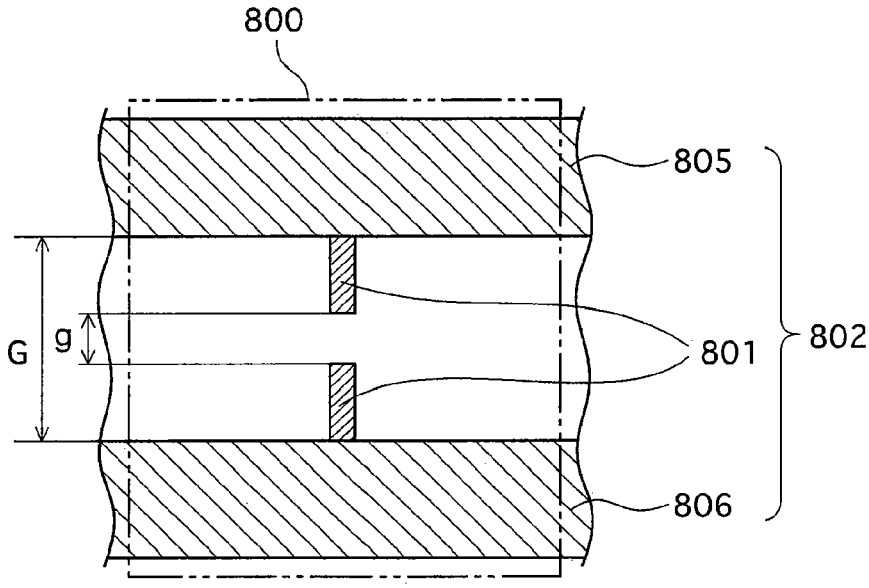
FIG.12 PRIOR ART
FIG. 12 is a relevant planar diagram showing part of a front plate of a PDP recited in patent document 4.

FIG. 10 is a schematic planar diagram showing a structure of a display electrode pair in a discharge cell of a PDP of embodiment 5, when viewed from a back plate of the PDP. FIG. 10 is a relevant planar diagram corresponding to FIGS. 6A to 9A, and a region enclosed in the dashed double-dotted line corresponds to a discharge cell.

As shown in FIG. 10, a display electrode 104 constituted from a scan electrode 105 and sustain electrode 106 pair is disposed so as to extend across two or more discharge cells, the scan electrode 105 and the sustain electrode 106 are constituted from a transparent electrode 151 and 161 and a bus electrode 159 and 169 respectively, and protrusions 118 and 119 having acutely angled tip edges are disposed in opposition so as to protrude out of opposing edges of the transparent electrodes 151 and 161.

Electrode machined parts 171 and 172 that extend from one of the bus electrodes 159 and 169 toward the other of the bus electrodes 159 and 169 are caused to protrude out of the opposing edges of the transparent electrodes 151 and 161, whereby when the transparent electrodes 151 and 161 and the bus electrodes 159 and 169 are considered to be bases, the portions protruding out from the bases are considered to be the protrusions 118 and 119. A gap g between a pair of opposing protrusions 118 and 119, which are formed from the same material as the bus electrodes 159 and 169, is made narrower than a gap G between the transparent electrodes 151 and 161.

For example, it is preferable for the gap g to be 5 [μm] when the gap G is 50 [μm] to 100 [μm], and for the tip edges of the protrusions 118 and 119 to be sharp-pointed acute angles of 5 degrees to 60 degrees.

Effects of the PDP of Embodiment 5

According to the above structure, electric potential is concentrated at not only the protrusions 118 and 119, but further concentrated at the tips thereof due to the tip edges being formed to have sharp-pointed acutely angled contours at surfaces parallel to the main surface of the scan electrode 105, and when power is supplied to the scan electrode 105 and the sustain electrode 106, a discharge can be reliably generated even with a low voltage, and the amount of variation in discharge delay times that occur in the discharge cells can be reduced. It is therefore possible to reduce power consumption while maintaining the picture quality of the PDP.

Also, due to being formed so as to extend out from the bus electrodes 159 and 169 and from the same material as the bus electrodes 159 and 169, the protrusions 118 and 119 can be formed at the same time as the microfabrication process used in the formation of the bus electrodes 159 and 169. Also, given that the electrical resistance from the bus electrodes 159 and 169 to the protrusions 118 and 119 can be reduced, the PDP can be easily manufactured, and furthermore, response can be improved while reducing the dimensions of the discharge cells, in order to realize a high-definition PDP.

Note that although the gap g between the opposing protrusions is set to the range of 1 [μm] to 10 [μm] in the above-described embodiments, the present invention is not constrained to this range, but rather may be set to greater than 10 [μm] due to circumstances such as the definition of the PDP.

Also, although the case of using a dense and thin dielectric layer formed by a CVD method or ICP-CVD method and including $SiO_2$ as a main component is described in the above embodiments, the present invention is similarly applicable even when using a dielectric layer formed by baking a thickly applied layer of a non lead-based glass or lead-based glass having a relative dielectric constant somewhat higher than $SiO_2$.

Also, although forming the dielectric layers so as to have a relative dielectric constant ∈ of 2 to 5 and a film a thickness d of 1 [μm] to 10 [μm] is described above, the dielectric layers may be formed so as to have a relative dielectric constant of 5 to 15 and a film thickness d of 10 [μm] to 45 [μm].

INDUSTRIAL APPLICABILITY

According to a PDP and manufacturing method for the PDP of the present invention, a plasma display panel having a reduced discharge inception voltage and improved luminous efficiency, reliability and quality can be utilized in large size televisions and high-definition televisions, large size display apparatuses, etc., and in the image device industry, advertising device industry, industrial devices, and other industrial fields, and has a very large and wide range of applications in such industries.

The invention claimed is:

1. A plasma display panel including a pair of substrates that are disposed in opposition to sandwich a discharge space therebetween, each of the substrates respectively having a plurality of band-shaped electrodes extending on a main surface thereof facing the discharge space, and each of the substrates respectively having a dielectric layer laminated on the main surface thereof so as to cover the plurality of electrodes, wherein the dielectric layer laminated on at least one of each of the substrates has a dielectric breakdown voltage of $1.0\times10^6$ [V/cm] to $1.0\times10^7$ [V/cm] inclusive, and a ratio (∈/d) between a relative dielectric constant ∈ and a film thickness d of the at least one dielectric layer is in a range of 0.1 [1/μm] to 0.3 [1/μm] inclusive.

2. The plasma display panel of claim 1, wherein the at least one dielectric layer includes Si atoms and O atoms, and has been formed by a chemical vapor deposition method.

3. The plasma display panel of claim 2, wherein the chemical vapor deposition method is an inductively-coupled plasma chemical vapor deposition method.

4. The plasma display panel of claim 1, wherein the at least one dielectric layer has a relative dielectric constant ∈ in a range of 2 to 5 inclusive.

5. The plasma display panel of claim 1, wherein the at least one dielectric layer has a film thickness d in a range of 1 [μm] to 10 [μm] inclusive.

6. The plasma display panel of claim 1, wherein on one of the substrates, the plurality of electrodes extending thereon form a plurality of pairs, a plurality of discharge cells are arranged in a direction in which the pairs of electrodes extend, the pairs of electrodes are each composed of a first electrode and a second electrode, and in each of the pairs of electrodes, each of the first and second electrodes includes a band-shaped base and a plurality of protrusions protruding from the base toward the base of the other one of the electrodes in the pair, at least two of the protrusions of the first electrode and of the second electrode existing in each cell.

7. The plasma display panel of claim 6, wherein in each of the discharge cells, the protrusions of the first electrode and the second electrode are arranged so as to oppose each other, and any two opposing protrusions protrude an equal distance, and adjacent protrusions protrude an equal distance.

* * * * *